US007665735B2

(12) United States Patent
Benedict, III

(10) Patent No.: US 7,665,735 B2
(45) Date of Patent: Feb. 23, 2010

(54) CLOSABLE-TYPE GAME BOARD BOX FOR STRATEGIC WORD PATTERN ENGAGEMENT

(76) Inventor: Milner Benedict, III, 10610 N. 30th, Apartment No. 40-C, Tampa, FL (US) 33612-6359

( * ) Notice: Subject to any disclaimer, the term of this patent is extended or adjusted under 35 U.S.C. 154(b) by 97 days.

(21) Appl. No.: 11/796,700

(22) Filed: Apr. 30, 2007

(65) Prior Publication Data

US 2008/0265508 A1 Oct. 30, 2008

(51) Int. Cl.
*A63F 3/00* (2006.01)

(52) U.S. Cl. ..... 273/265; 273/272

(58) Field of Classification Search ..... 273/265, 273/272, 299

See application file for complete search history.

(56) References Cited

U.S. PATENT DOCUMENTS 3,514,110 A * 5/1970 Thomander ..... 273/265
4,059,273 A * 11/1977 Kindred ..... 273/265
4,188,036 A * 2/1980 Jones-Fenleigh ..... 273/265
5,154,428 A * 10/1992 Woolhouse ..... 273/265

OTHER PUBLICATIONS http://www.lessonplanspage.com/LASpellBattleship3JH.htm, how to play Spelling Battleship, Apr. 2000.*
http://www.superteacherideas.com/spelling2-battleship.html, Super Teacher Ideas website, Battleship Spelling, Feb. 2009.*
http://en.wikipedia.org/wiki/Battleship_(game), Battleship game as describe in Wikipedia website, Feb. 2009.*

* cited by examiner

*Primary Examiner*—William M Pierce

(57) ABSTRACT

My child educational board game, "Word Battle", requires players to approach word learning, sequencing, and construction from a naval/military strategist point of view in that instead of targeting objectives in a mere hit-or-miss situation, where the goal in and of itself is to reach and eliminate occupied coordinates, he/she must locate and actually identify the quality of opponents' pieces (these being letters) before the other competitors capture or eliminate out of play all his/her own word patterns.

6 Claims, 34 Drawing Sheets

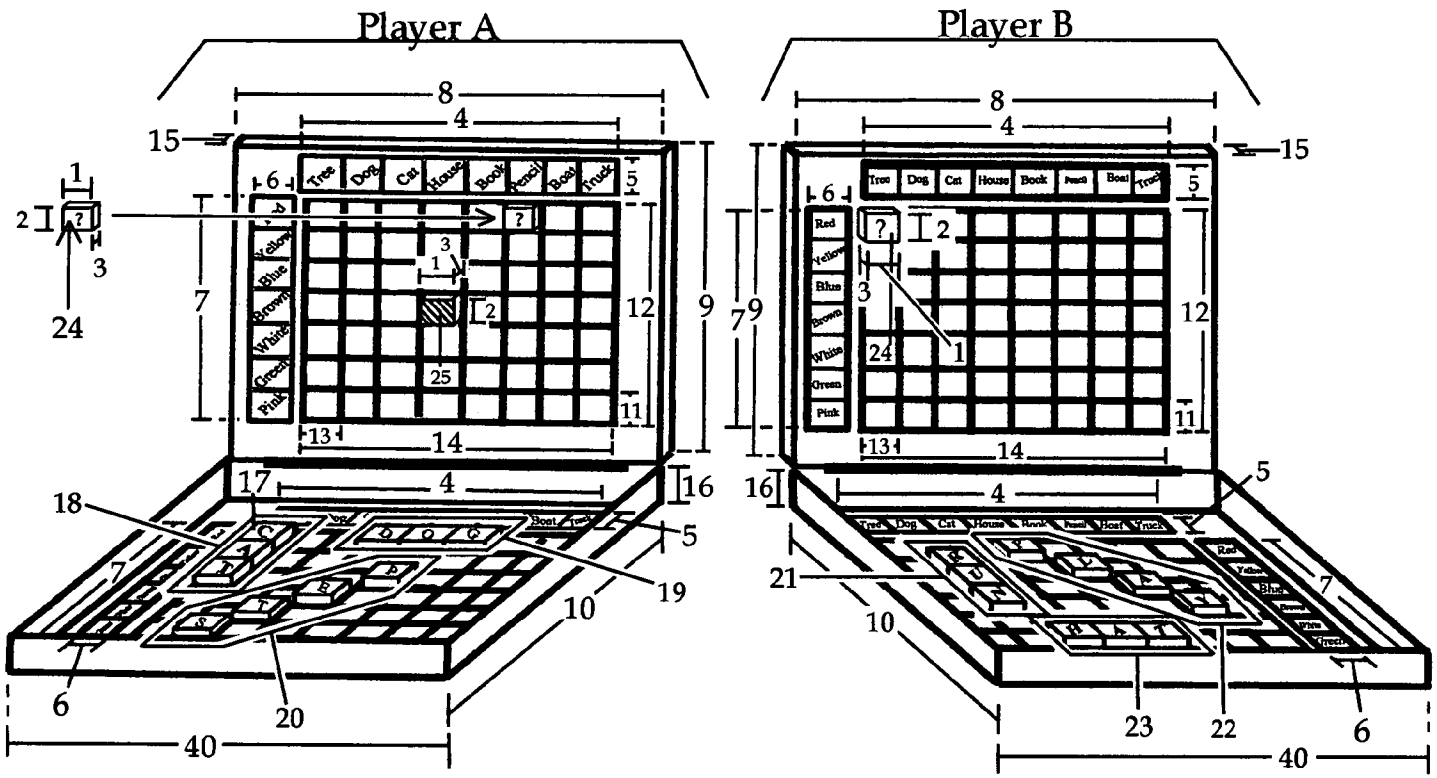
Player B
Player A
Tree
Dog
Cat
House
Book
Red
Yellow
Blue
Brown
White
Green
Pink
Truck
Boat
Car
Bike
Plane
Train
Bus
Van
Jet
Tank
Rocket
Helicopter
Motorcycle
Sailboat
Tractor
Ambulance
Fire Truck
Police Car
Dump Truck
Cement Truck
Tow Truck
Pickup Truck
Garbage Truck
Taxi
Limousine
Convertible
Sports Car
Station Wagon
Van
Jeep
Pickup Truck
Sedan
Coupe
Hatchback
Minivan
Sport Utility Vehicle
Convertible
Limousine
Taxi

CLOSABLE-TYPE GAME BOARD BOX FOR STRATEGIC WORD PATTERN ENGAGEMENT

BACKGROUND OF THE INVENTION (1) Field of the Invention

This invention involves a game of skill and requires a demonstration of vocabulary knowledge, logical reasoning and sequencing abilities—all of which are enhanced during play of this invention. More specifically, the present invention concerns, but is not restricted to, the area of child educational development. Further, it is at once adaptable to any of the related Indo-European languages, and can be further adapted to the Asian languages.

The key element of this invention comprises a closable-type box apparatus where grid regions are imprinted on the top box lid, and being connected to a bottom container of the same dimensions, opens to a ninety-degree angle wherein two more grids of the same height, length, and number of units are revealed as being imprinted on the interior surface of the top lid and the interior surface of the bottom portion of the apparatus.

The apparatus/invention operates as a concealing mechanism for words formed by opposing players in competition. Each player, or team of players, uses the bottom game grid to create words inside the apparatus via magnetized lettered tile pieces which are affixed onto individual spaces of the bottom interior grid. The upper grid on the inside of each apparatus is used to chart and track the progression of a player's attempts to locate and identify his/her opponent's words. In essence, the interior upper grid, inside the apparatus, represents the opponent's game region—the focus of attack. In a competition involving more than two players or teams, the hit or miss attempts against one's own region are identified on his/her own outer grid; he/she places the magnetized letters and other identifying game pieces onto the outer top grid as letters and their composite words are identified and eliminated out of competition. Obviously, the outer lid grids are visible to all opponents and therefore maintain the orderliness of who has eliminated what during play. Thus, this allows multiple players or teams to visually asses the game status of fellow competitors and judge future attempts to capture others' letters.

The game, as defined by the invented apparatus, while retaining aspects of similar commercial products, is characterized by its emphasis on elimination of pre-arranged words and configurations thereabouts. This enhances the game's ability to achieve and maintain involvement in several ways: (1) through requiring strategic placement of letters onto grid coordinates in ways which will prevent or delay opponents discovering such; (2) enabling players opportunities, by means of arbitrary and calculated guesses in various play options, to determine the precise locations and identities of opponents' letters before participants capture his/her own placed word grouping patterns, or in the case of more than two players or teams, being the last player or team with letters remaining on his/her or their bottom interior game grid—that region which is the focus of attack for the other opponent(s).

It is the element of attempting elimination of opponent's "fleet" of words which lends the game to aspects of simulated warfare. The game can therefore be categorized in a salvo classification.

(2) Description of Related Art

Games, where two participants play in opposition, have been provided which typically comprise a boxed apparatus. When this apparatus is opened, a pair of areas sectioned equally into coordinate grids of similar size and numbered units is revealed. Each coordinate within the pair of grids typically has an aperture into which valued game pieces are inserted and removed. A particular player's grids are hidden from the view of the competing opponent during play. One grid in the apparatus is for placement and prepositioning of valued game pieces—the targets that the opponent is to eliminate. The second grid in the apparatus is utilized relative to the opponent's action area—the grid onto which he/she has placed his/her own valued game pieces. The second grid is therefore used to record the attempts made in targeting and eliminating the opponent's valued game pieces. Thus, such a game is essentially a military or naval style product whose objective is to be the first in locating and eliminating the opponent's units.

An example is typified by Thomander in U.S. Pat. No. 3,514,110 which sets forth a boxed game board divided into a pair of identical sections adapted to be arranged adjacent to each other and separated by an upright barrier formed from the box lid so as to obscure the selected placement of ferruled game pieces on one of the boards from the view of opposing player. "Hit" or "miss" attempts relative to the opponent's grid placements are recorded on one of a player's grids. Once there is a hit, that is recorded not just by that player on one of his/her grids, but by the second opponent by inserting markings onto his/her own valued pieces.

Another example is set forth by Woolhouse in U.S. Pat. No. 5,154,428 where the two playing fields, each composed of a pair of sectioned grid areas, are mounted to each other in a way that provides for ease of assembly and disassembly into a carrying case for transport.

Of course, the origin of such games is "Battleship"—a pencil and paper game invented by Von Wickler and then formally published as a pad and pencil game by Milton Bradley in 1943. These games have been restricted to competition between 2 players (see http://en.wikipedia.org/wiki/Battleship_ (game)).

Further, there are various word-forming type games where objectives vary, but whose underlying theme is creating, strategizing toward, solving for and discovering words and their composite letters. An example is typified by Kindred in U.S. Pat. No. 4,059,273 which sets forth a game that comprises a board having twenty six rows of playing areas arranged in five columns, into which playing pieces may be placed. An opponent attempts to break a hidden code formed by the pieces. The rows are numbered A-Z and the attempts are scores according to the nearness to an accurate guess by the player. The code has five such letters forming a word, one letter per column.

Another example is typified by Jones-Fenleigh in U.S. Pat. No. 4,188,036 which sets forth a game comprising a board, a holder, a set of playing pieces, a set of marking elements, a set of scoring elements, and a word list. The board has a number of rows of playing areas which serve as test areas for a player's attempts in duplicating a hidden code word chosen by the player's opponent.

While military/naval style games have been provided where participants strategically place valued pieces in coordinate grids and attempt to locate and eliminate one another's pieces within a defined area, and while there are various word-forming type games whose underlying theme is creating, strategizing toward, solving for and discovering words and their component letters, it is important to note that games have been provided regarding the injection of letters, instead of military or naval units, into a grid coordinate system so as to represent a "fleet" of words for elimination by an opponent Several games have been published on-line which provide set-up instructions and rules for such competitions.

For example, http://www.superteacherideas.com/spelling2-battleship.html has the game activity "Sink and Spell" where students make a sheet with two grids. Letters are written on the top and numbers to the side for coordinate identification. The players then write words into the grids. Coordinates are called out. A miss indicates no letter in a particular space, but a hit results in the opponent revealing the letter. This game is played by a pair of opponents.

Another example posted on this website, "Battleship Spelling", is a more detailed version of "Sink and Spell" with guidelines regarding number of words to use and dimensions of paper sheets on which to create the grids. The listing actually states that this is "just like the Battleship board game".

Http://www.lessonplanspage.com/LASpellBattleship3JH.htm, posts "Spelling Battleship" with the rule that once there is a "hit" on any particular coordinate, the opponent is immediately told the word and he/she then has to spell it correctly. If that player correctly spells the word, he/she gets a point and the word is revealed in its entirety; otherwise the turn is lost. That player, however, may reattempt the spelling on the next turn by calling the space coordinate. The first player to locate and spell all the words on his/her opponent's grid wins.

An advantage of military/naval style games of the prior art is developing within players the skills important for tracking dispersal of attacks over a coordinate system and anticipating where the next "hits" could be. This advantage is constrained, however, in that they engage players on mere hit-or-miss cues, limiting assessments to success failure ratios between opponents' progress against one another's targets. Advantages of word games of the prior art encourage players to develop spelling abilities for accurate vocabulary usage, as well as to figure out how words are encoded into language, their meanings, and differences in relation to one another for the ultimate objective of communication.

These two key features: (1) initiating, tracking, and assessing the success or failure in targeting unknown pre-positioned objectives within a military/naval style grid coordinate-type system, and (2) creating and solving for words in a puzzle-type environment have been combined by inventors to create innovative games. Substituting words and their respective letters for military/naval units into the typical coordinate grid system of a sectioned, visually hidden region is a clear advantage of such inventions. The result is an expansion of the identifiable qualities of each occupied coordinate so that, once a unit is determined to be occupied, arbitrary guesses leading to more calculated judgments can be taken, thus bringing a mere salvo objective to one where vocabulary can increase the necessity for higher logic and sequencing skills.

Typically, where games require a level of skill from players, it must be arranged in a way that provides adequate challenge to players/teams. Even though the game board is uniform throughout, the region itself changes as players agree from competition to competition on labels for rank (row) and file (column) to map the coordinate region. These labels can be letters, numbers, colors, objects, or such. This therefore keeps the apparatus' themselves changing and new, to an extent.

But over time, even this dynamic can become familiar, to the point of simplicity since the rules governing the word attack apply uniformly throughout the game board playing field. What adds complexity is the level of knowledge players bring to the game. In theory, the level of difficulty would only be limited by the degree of scholarship; college graduates with complex word knowledge could increase the level of challenge. Since the rules remain somewhat straight forward, the game can be as easy or as difficult depending on the sophistication of the players, whose talents ultimately govern the complexity of the competition itself.

It is important to note that a key disadvantage of previously provided word-salvo games is their allowance for a maximum of two players in any competition. They are thus limited in the scope of complexity which could be achieved through three or more opponent play.

BRIEF SUMMARY OF THE INVENTION

It is accordingly an object of the present invention to provide a game of skill which avoids the aforementioned problem of the prior art—that being the word-salvo type games' limitation of a total number of potential opponents to two players in any given competition.

The object of the present invention is further to provide a closable-type game board box which opens to ninety degree angle from its bottom interior, and when paired with or brought together with other apparatuses, may enable two or more players to arrange words on their bottom interior grids, with each letter occupying individual coordinates, and, through initially arbitrary but increasingly strategic and calculating guesses, to be the first to capture all of the opponent's letters, or in the case of having three or more players, to be the last remaining contestant with un-captured letters on his or her game grid.

It is further an object of the present invention to provide a game of word and logic skill that allows for more than two players to compete in any given competition.

The advantages of the game which are the object of the present invention are the following:

- The child's critical thinking skills are developed by requiring him/her to predict the correct sequence of various words on an opponent's grid and successfully targeting the individual coordinates in the opponent's region so as to determine the exact identities of concealed letters;
- spelling and vocabulary skills are strengthened as these knowledge tools better enable player's odds of winning;
- correct spelling acquisition is challenged and fostered as players critically predict what the correct letters on associated coordinates are given the apparent sequence of letters which will emerge during the course play;
- skills of strategy and attack are developed by determining what words and intersections of words pre-positioned in player's grid will yield the longest duration of competition while providing enough opportunity for him or her to capture all the letters of all the words in the opponent's grid;
- logic and sequencing skills are enhanced through critically realizing what words are in fact on the opponent's grid given the patterns which emerge as letters are captured within the grid.
- Last and most important, to make it possible for three or more opponents to compete in any given word-salvo type competition by discovering pre-positioned and hidden words and their component letters with the goal of being the last player with letters remaining on his/her own grid-field, the target of the opponents.

BRIEF DESCRIPTION OF SEVERAL VIEWS OF THE DRAWINGS

The present invention is further described hereinafter with reference to the parts, their assembly and relationships, shown in the accompanying drawings, in which:

FIG. 13 through FIG. 18 demonstrate a series of moves between Players A (left grid) and Player B (right grid);

DETAILED DESCRIPTION OF THE INVENTION

Figure 5:
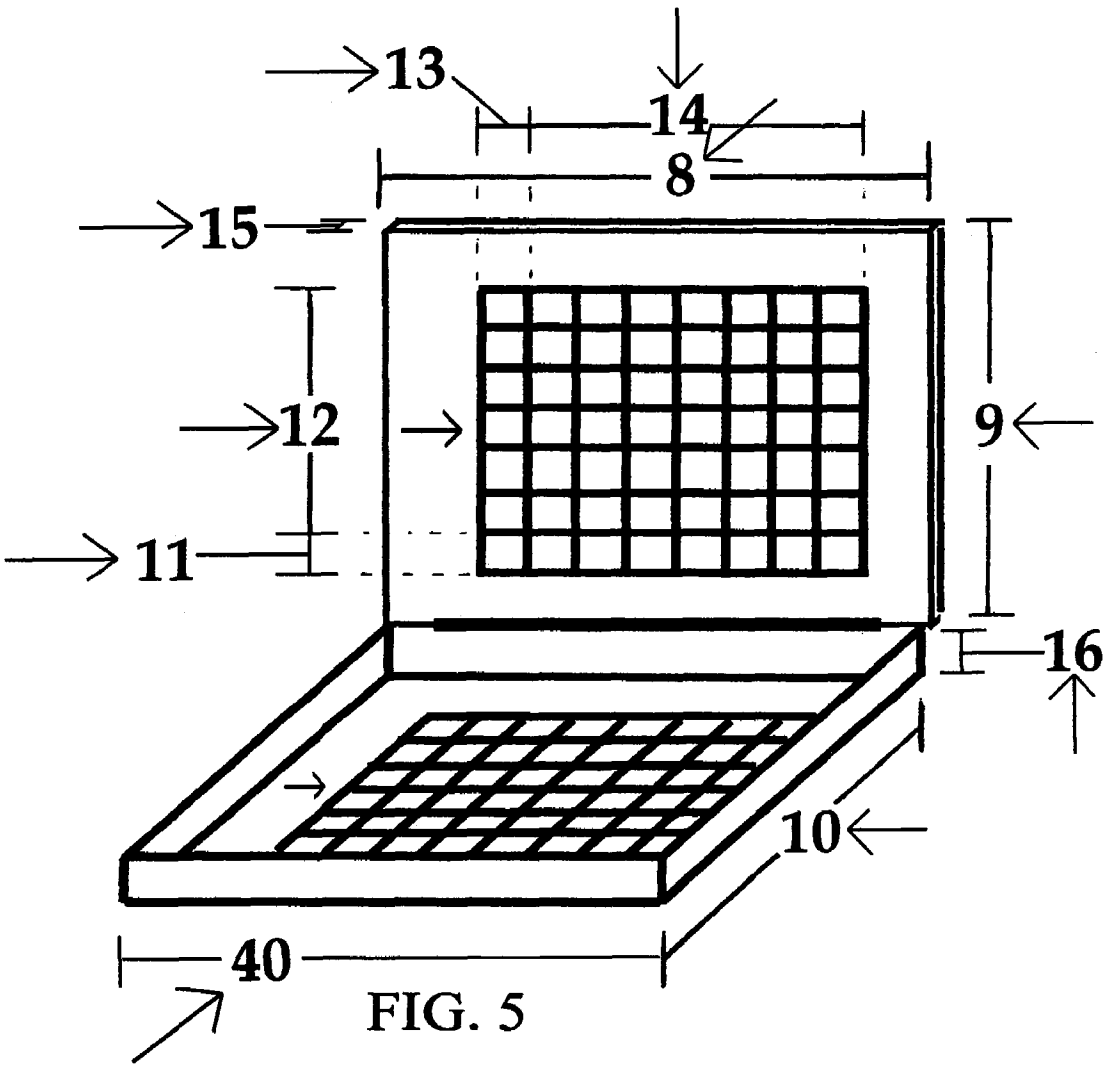
FIG. 5 represents the front view of the closable-type game grid board Box.

As can be seen from the above figures, the game comprises a box-type apparatus (FIG. 5, FIG. 6) which opens to a ninety degree angle. There are two grids located on the inside of the apparatus (FIG. 5). These are intended to be visible only to an individual participant during competition. There is an outer grid located on the upright lid of the game grid box (FIG. 6), which is utilized in competition of 3 or more opponents.

The upper interior grid (FIG. 5), whose height 12 measures a varying size of approximately between 0.1 and 0.40 inches and whose length 14 measures a varying size of approximately between 0.1 and 40 inches is the map region of coordinates which a particular participant uses to target opponent's letters for either capture or elimination from that opponent's interior bottom grid region, depending on number of players in competition. It should be emphasized here that all grids are of congruent dimensions, holding an equal number of predetermined rows, columns, and number of unit spaces.

The lower grid (FIG. 5), whose measures of height and length are the same as those for the upper grid, is the region of coordinates onto which a particular participant places his or her own word patterns, thus becoming the object of capture or elimination by his or her opponent(s). The outer grid, located on the upright lid (FIG. 6), is of equal height 12 and length 14 to the two inner grids. All grids on the game apparatus have an equal number of coordinate units.

Figure 1:
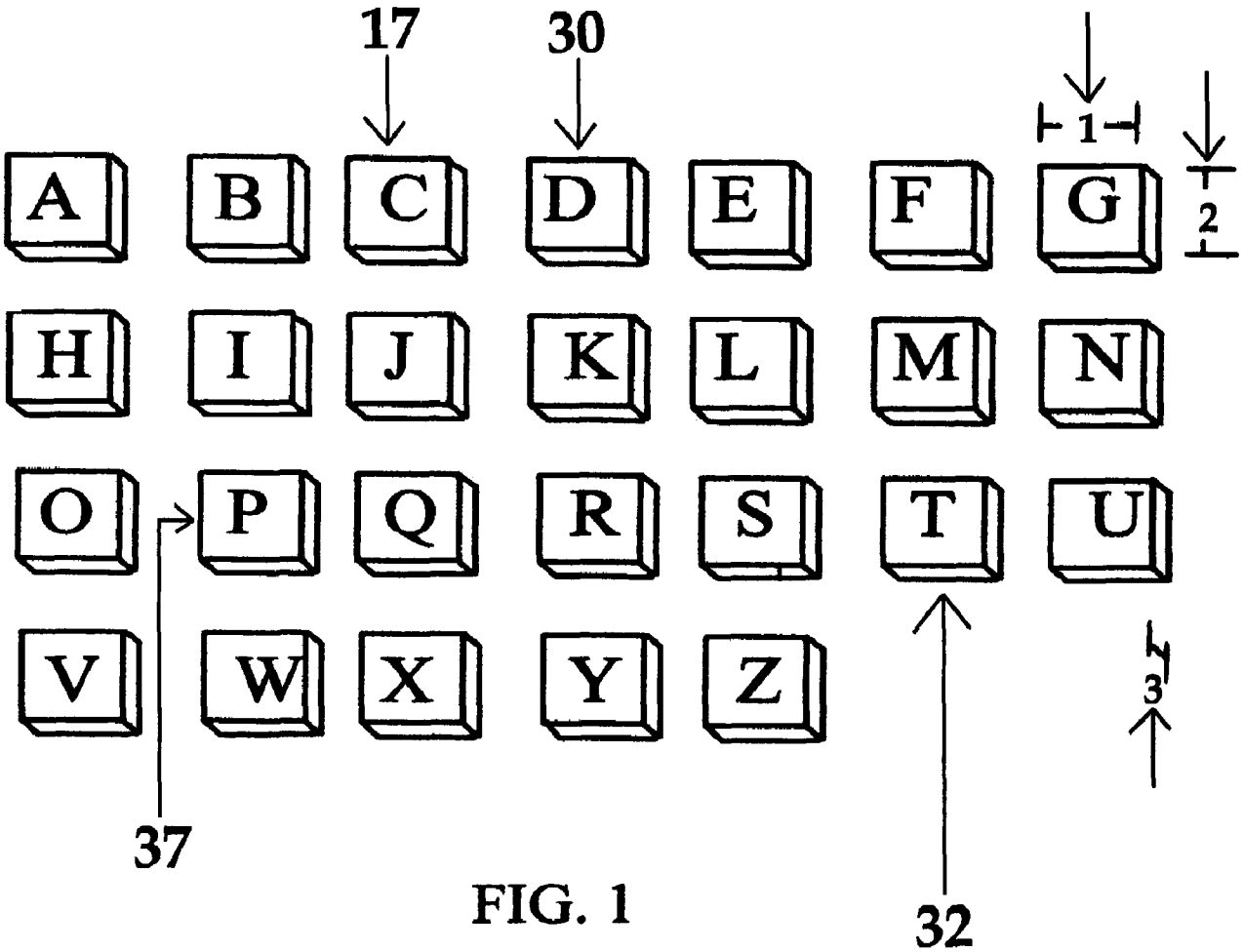
FIG. 1 represents the magnetized lettered chips, with chip "C" numbered as 17, chip "D" numbered as 30, chip "P" numbered as 37, and chip "T" numbered as 32 for the purpose of reference in this application.
Figure 2:
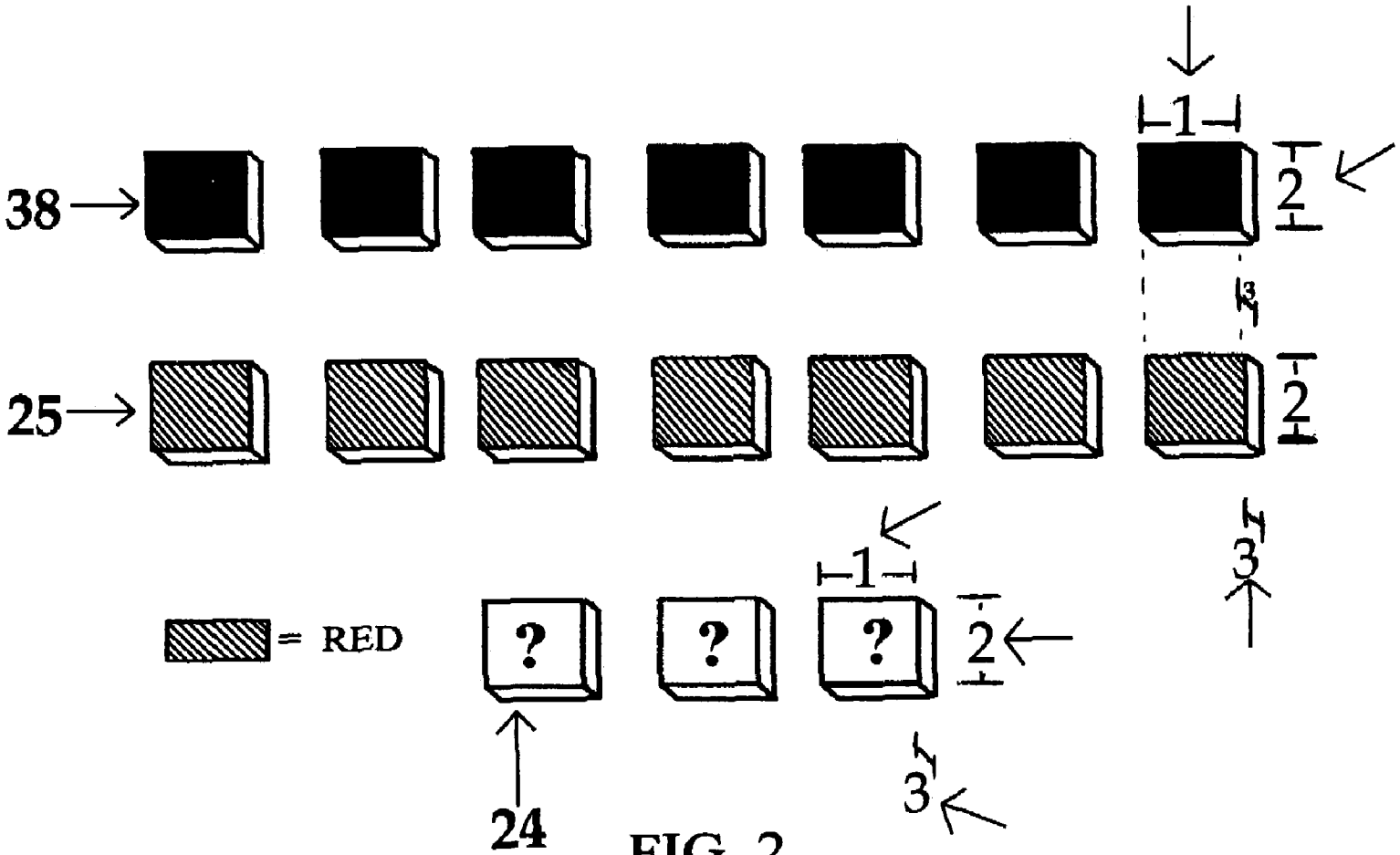
FIG. 2 represents the magnetized black, red, and question mark chips, with the black chips numbered as 38, the red chips numbered as 25, and the question marked chips numbered as 24 for the purpose of reference in this application.

The individual coordinates of each grid region (playing field) are rectangular in shape, and of equal measure on each side. The sides of each coordinate, length 13 and height 11, vary in size of approximately between 0.1 and 40 inches (FIG. 5 and FIG. 6) The chip pieces (FIG. 1 and FIG. 2) measure the same dimensions in length 1 and height 2 as the individual coordinates on each grid region, with the obvious exception that the width of the chips vary in size of between approximately 0.01 an 5 inches (FIG. 1 (3) and FIG. 2 (3).

The grids are rectangular in shape and can vary in the exact number of columns and rows or total number of units per region. For this application, the rank of each grid is numbered in eight rectangular units (FIG. 5 (14) and (FIG. 6 (14)) (FIG. 6 (*g*)) and the file is numbered in seven rectangular units (FIG. 5 (12)

Figure 6:
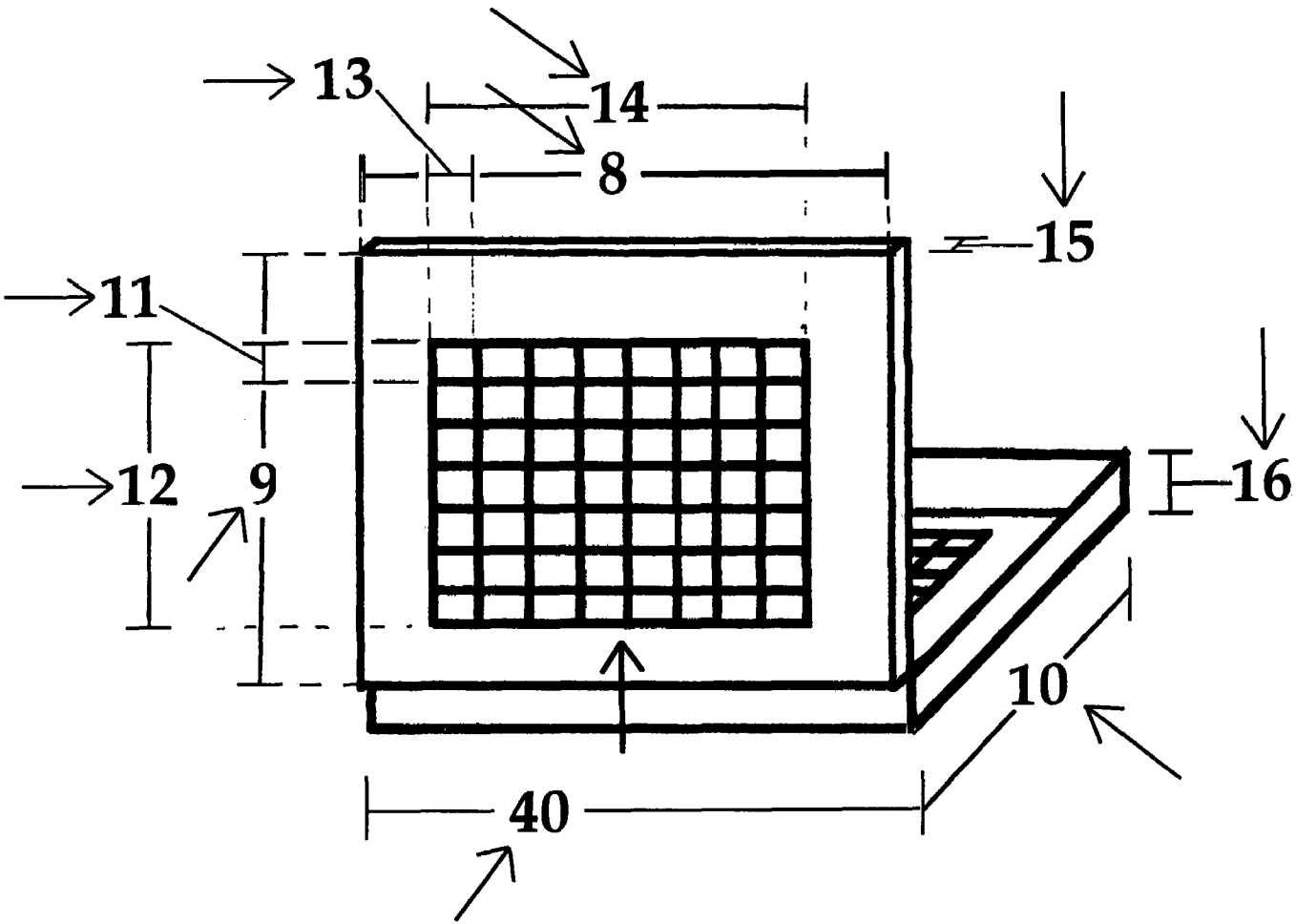
FIG. 6 is the back view of the closable-type game grid box which is that part of the apparatus visible to opposing players during competition.

The rectangular dimensions of either the top lid or bottom open-sided container, both of which are hinged together to create the box itself, vary in measure of approximately between 0.1 and 40 inches in height (FIG. 5 (9 and 10) and FIG. 6 (9 and 10)) and of approximately between 0.1 and 40 inches in length (FIG. 5 (8 and 40) and FIG. 6 (8 and 40)). The height and length dimensions of the lid and open-sided bottom container are congruent, allowing for a perfect fit between the two when hinged together on one side, so as to be opened and closed. The sets of game pieces and coordinate labels may therefore be stored within the apparatus when not in use. Additionally, the total width of the box-type game apparatus when closed is between approximately 0.1 and 40 inches, with the base width 16 measuring between approximately 0.1 and 40 inches (FIG. 5 and FIG. 6) and the width of the lid 15, which is upright in a ninety degree angle during competition, measuring between approximately 0.01 and 40 inches (FIG. 5 and FIG. 6).

Figure 3:
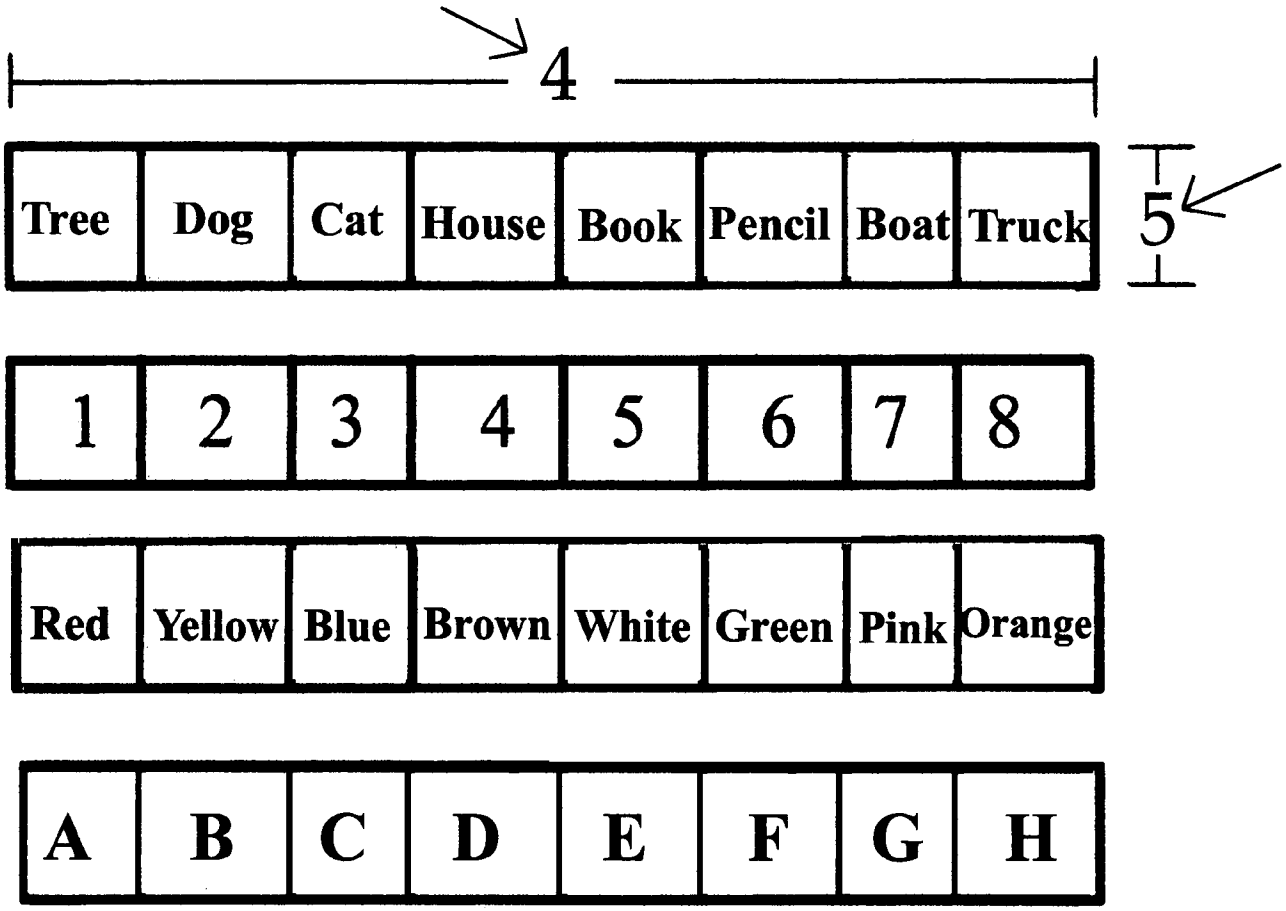
FIG. 3 represents the various top row (rank) identifying coordinate magnetized labels, with the length identified in a bracketed number 4 and the height identified in a bracketed number 5 for the purpose of reference in this application, which are to be affixed just above or below the game grids, as shown in FIG. 8.
Figure 4:
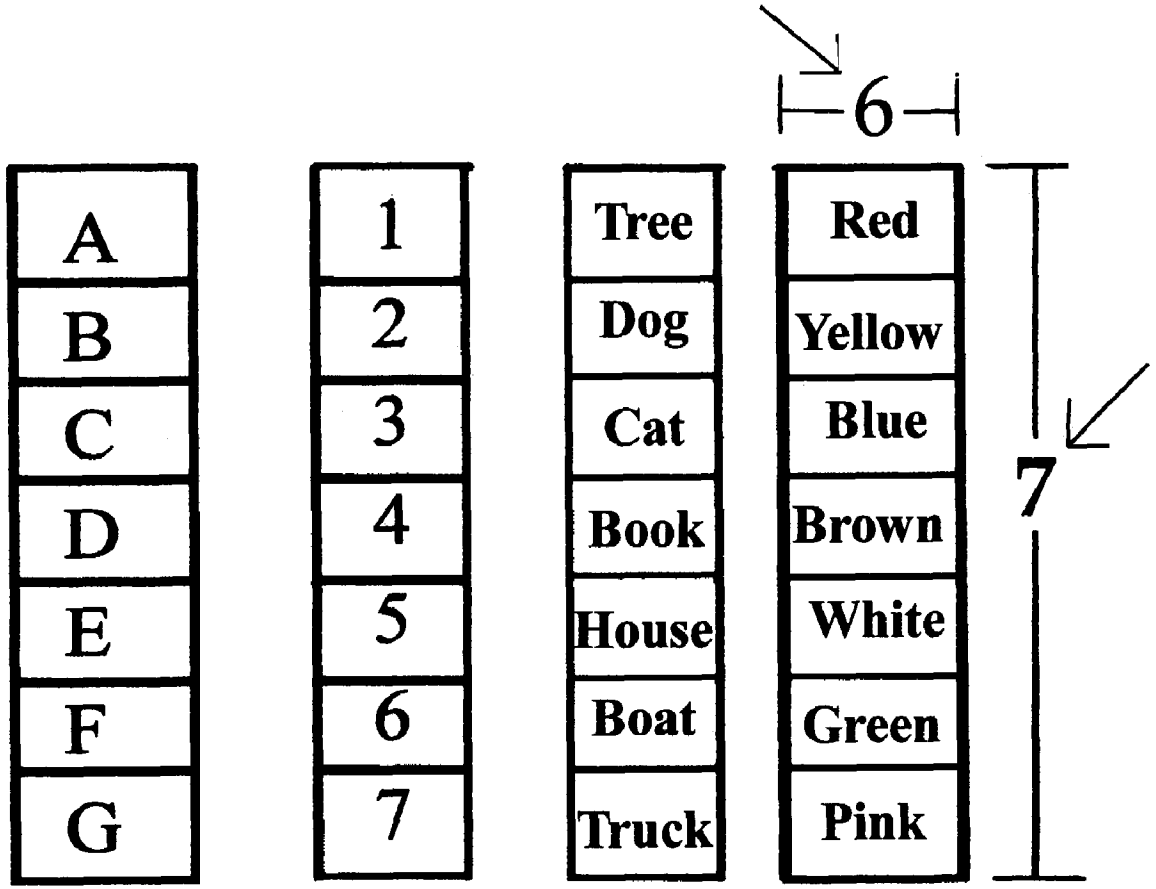
FIG. 4 represents the various side column (file) identifying coordinate magnetized labels, with the length identified in a bracketed number 6 and the height identified in a bracketed number 7 for the purpose of reference in this application, which are to be affixed just to the left or right sides of the game grids, as shown in FIG. 8.

So as properly to identify the rank and file coordinates, magnetized labels can be affixed above or below and to the sides of all actual grids. The length of the rank labels varies in measure of approximately between 0.1 and 40 inches (FIG. 3 (4), and the height measures approximately between 0.1 to 40 inches in height (FIG. 3 (5). The length of rank labels is congruent with the length of the game grid, with an equal number of unit spaces marked off. The height of the file labels varies in measure of between approximately 0.1 and 40 inches (FIG. 4 (7), and the length of the file labels measures between approximately 0.1 and 40 inches (FIG. 4 (6)). The height of the file labels is congruent with the height of the game grid, again with an equal number of unit spaces marked off.

Figure 7:
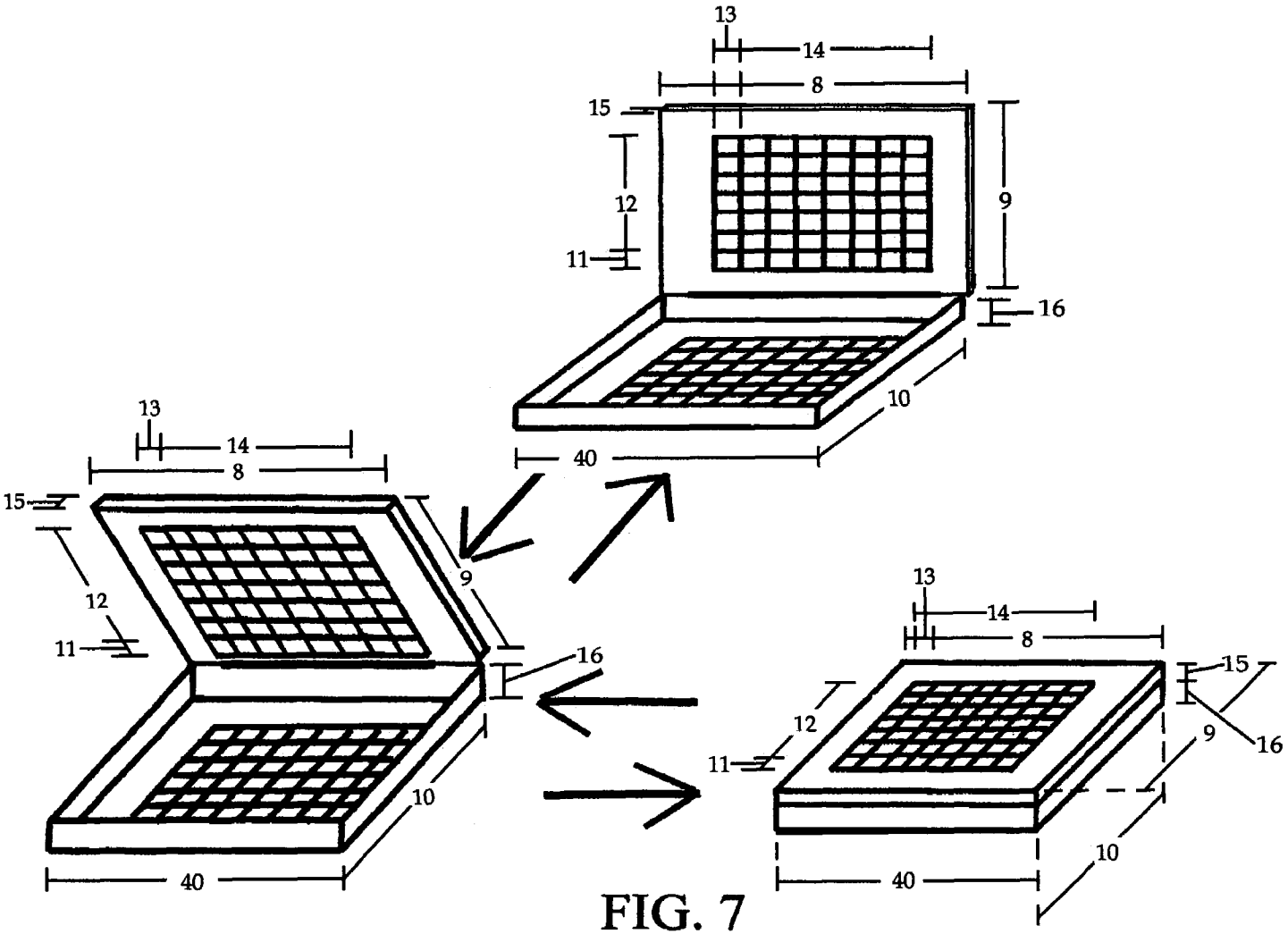
FIG. 7 demonstrates the opening and closing of the game grid box apparatus.
Figure 8:
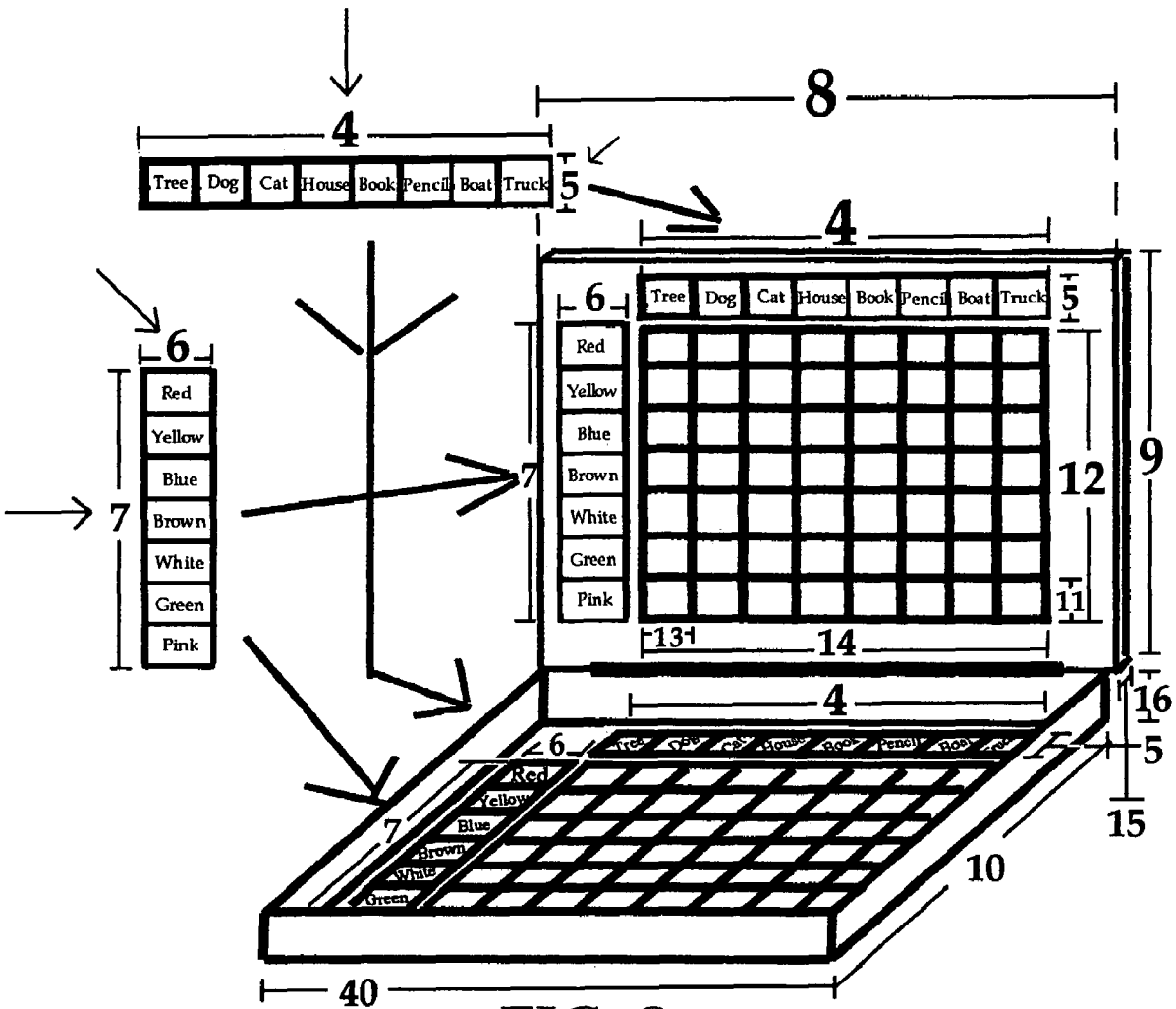
FIG. 8 demonstrates affixing of rank and file coordinate labels to the closable-type game grid box apparatus.

FIG. 7 demonstrates opening and closing of the game apparatus, into which the game pieces may be stored Each player must use the same rank and file labels for each grid during competition. It is permissible, however, to mix and match identifiers on the grids. Numbers or letters can be used for the rank coordinates, while colors or objects may represent file coordinates, and vice versa. For this application, objects labels 4/5 are used in the illustration of game play for the top row (rank) and colors labels 6/7 are used for the side columns (file) (FIG. 8).

Figure 9:
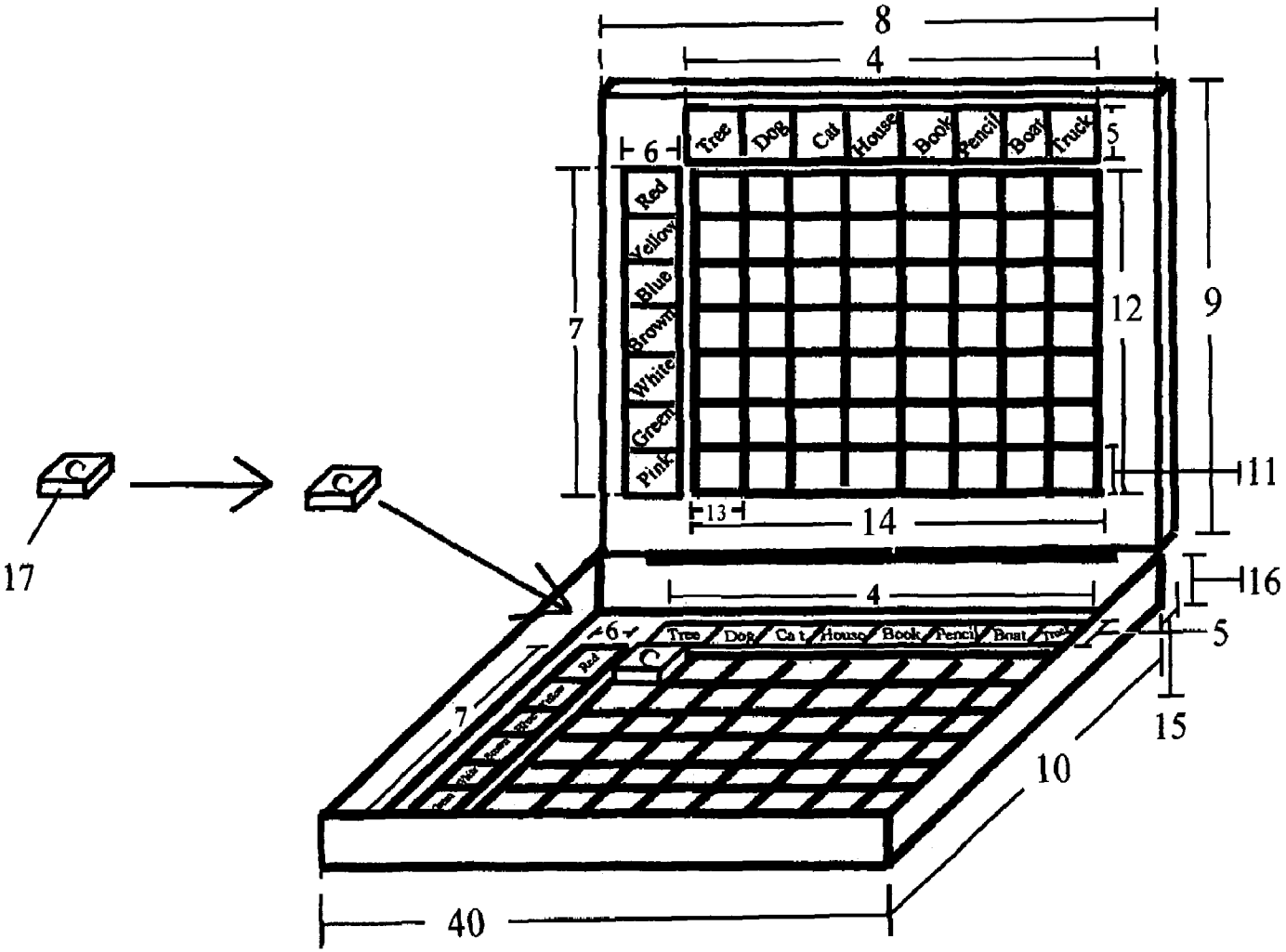
FIG. 9 demonstrates the placement of a magnetized lettered chip, "C" 17, onto the bottom interior game grid of Player A's region.
Figure 10:
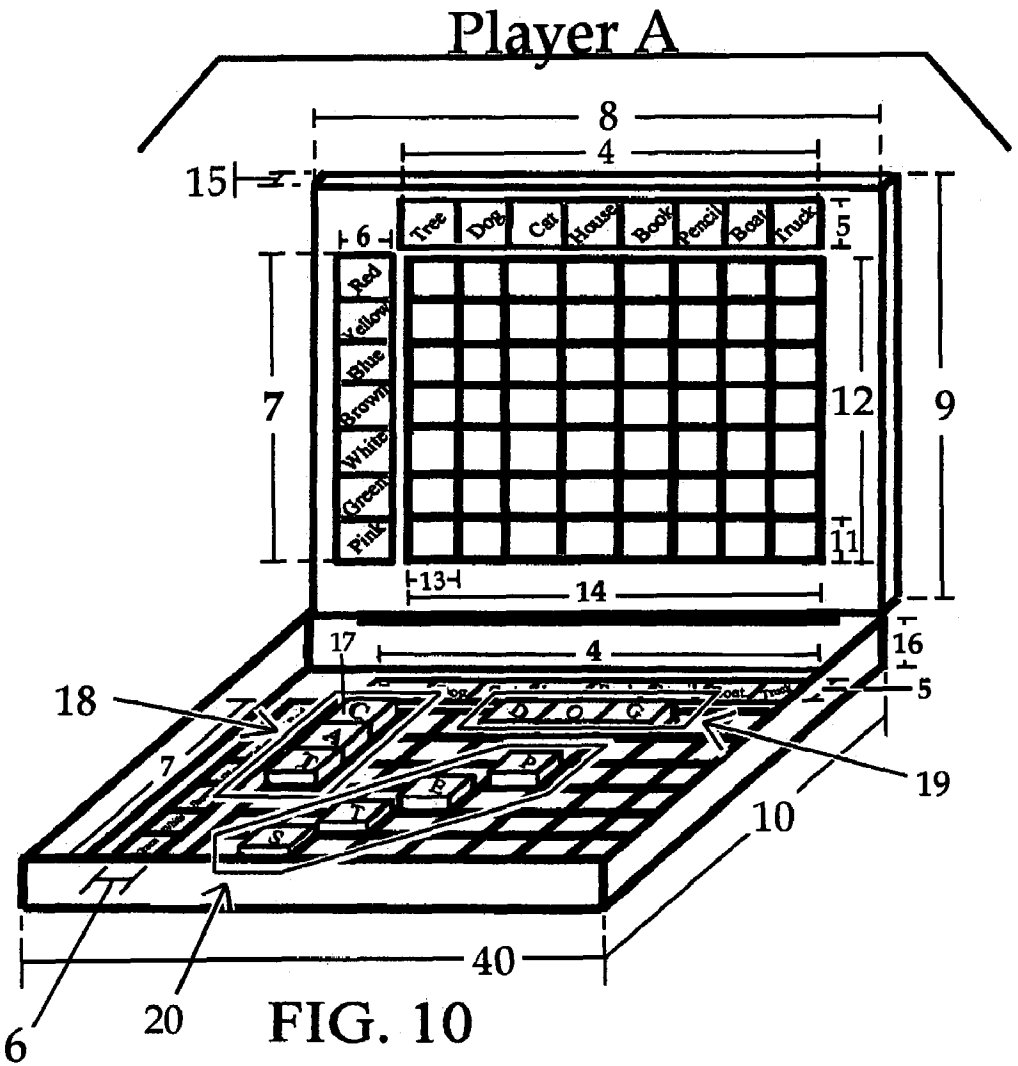
FIG. 10 represents Player A's arrangement of words onto his/her region in preparation for two opponent competition.
Figure 11:
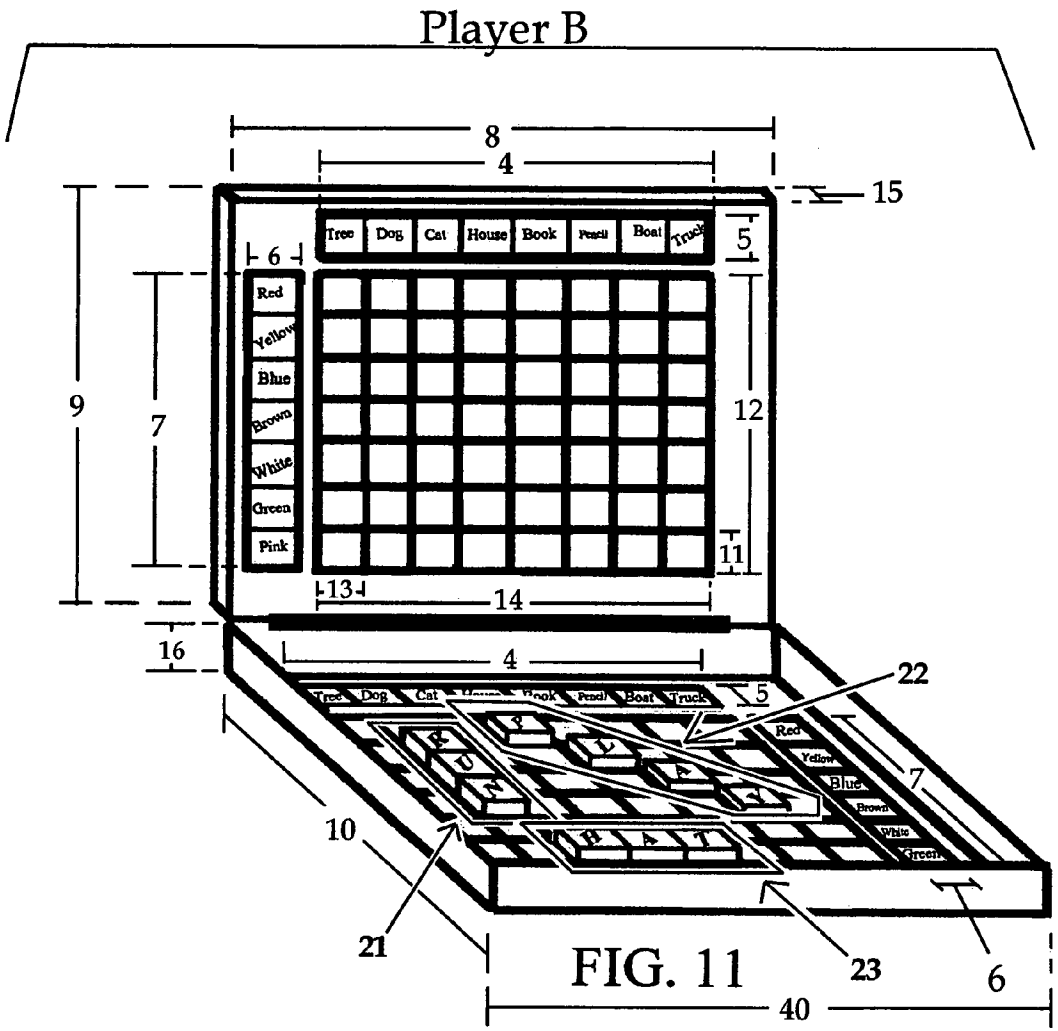
FIG. 11 represents player B's placement of words onto his/her bottom interior grid region in preparation for two opponent competition.

Player A (FIG. 9 and FIG. 10) assembles his/her words—18 "Cat", 19 "Dog" and 20 "Step", letter by letter for each coordinate, on the bottom interior grid of his/her game apparatus. Player B does the same by assembling the words 21 "Run", 22 "Play" and 23 "Hat" on the bottom interior grid of his/her game apparatus in final preparation for play (FIG. 11).

Figure 11A:
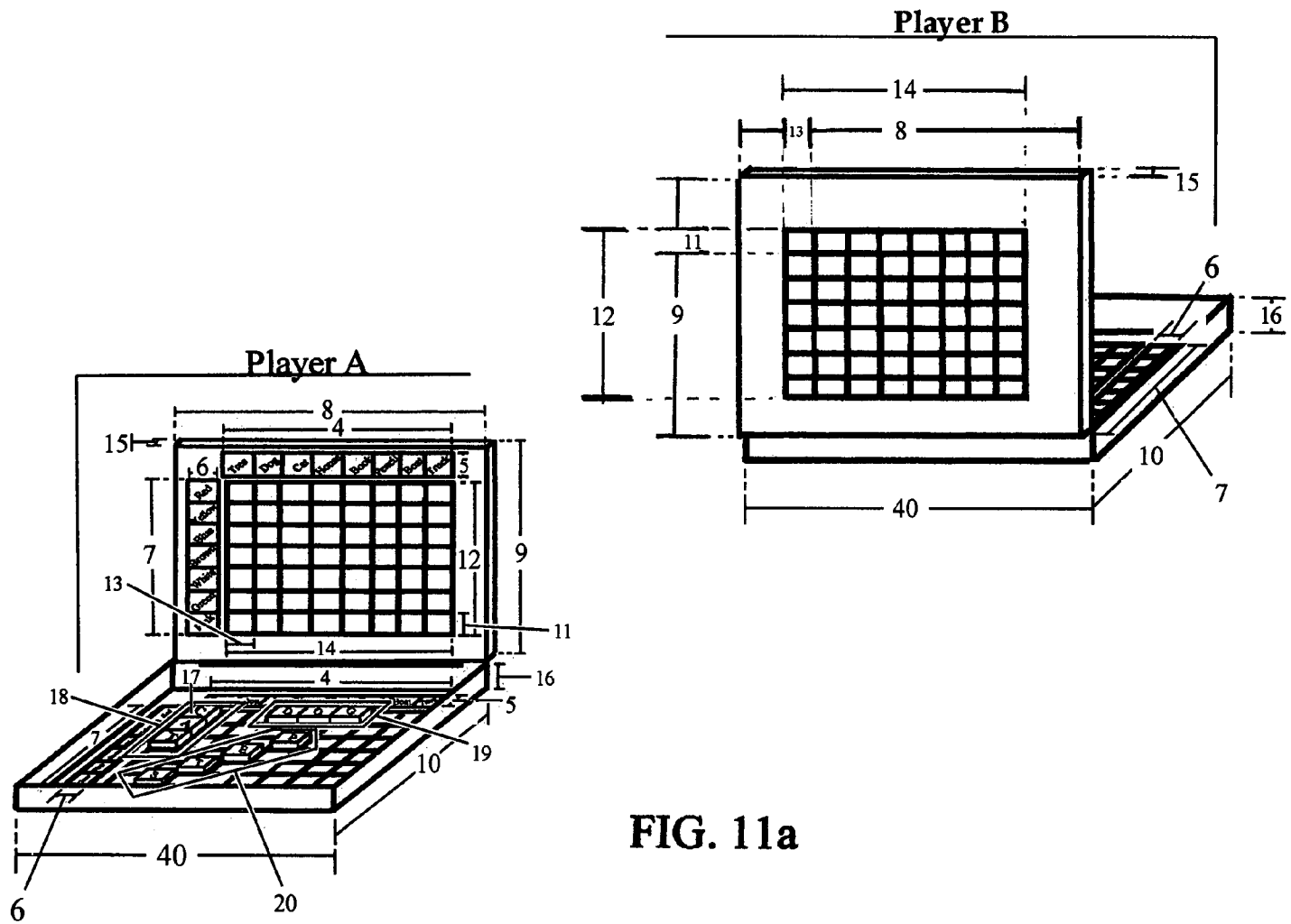
FIG. 11*a* represents the actual positioning of closable-type game grid boxes for play between 2 opponents.
Figure 12:
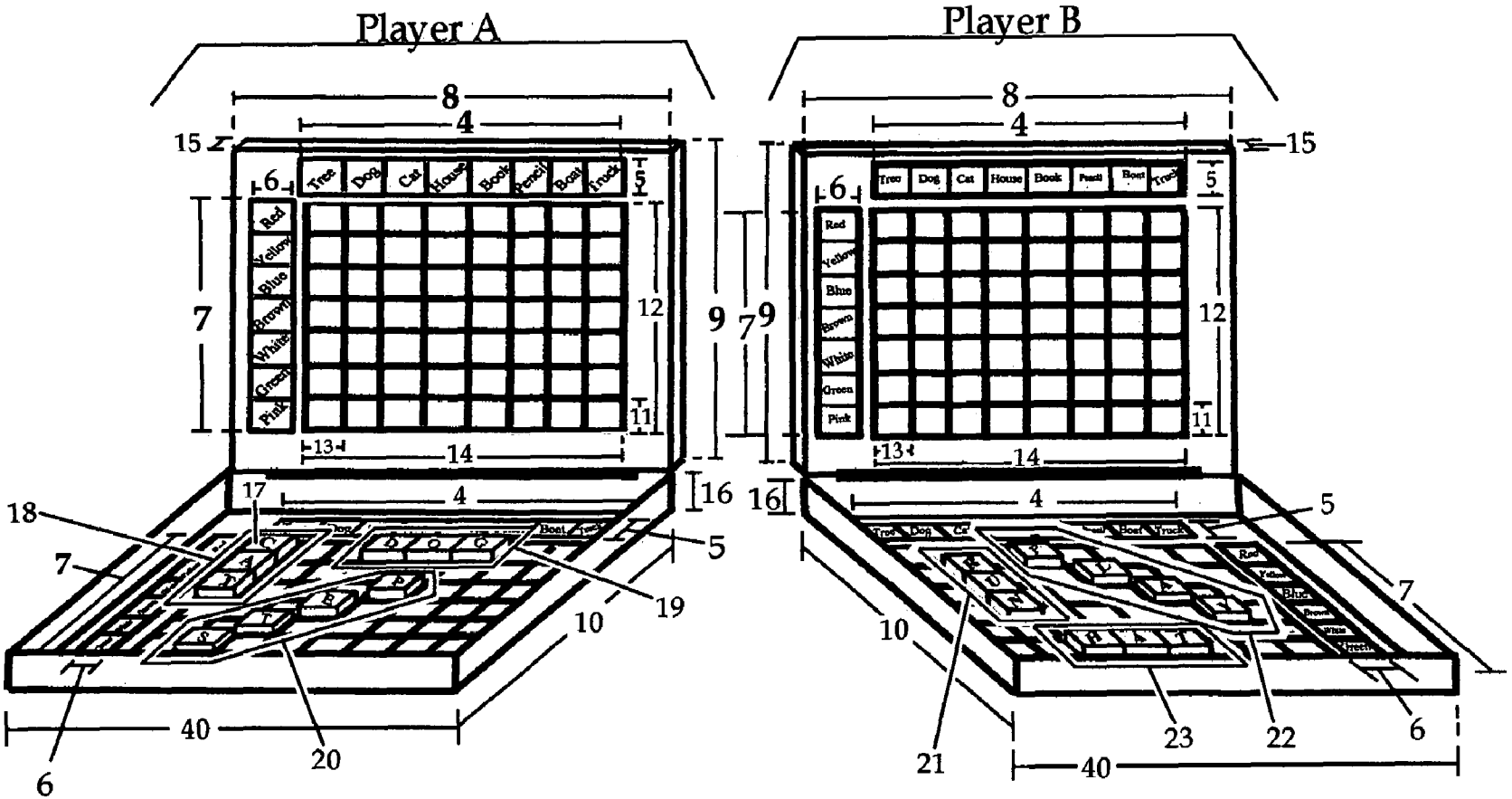
FIG. 12 represents positioning of Player A (left game box) and Player B (right game box) used to illustrate competition in this application.

FIG. 11*a* shows how a two player competition would most likely position the game apparatuses for live play. For the purposes of this application, the closable-type game grid boxes will be angled side by side starting with FIG. 12.

Figure 13:
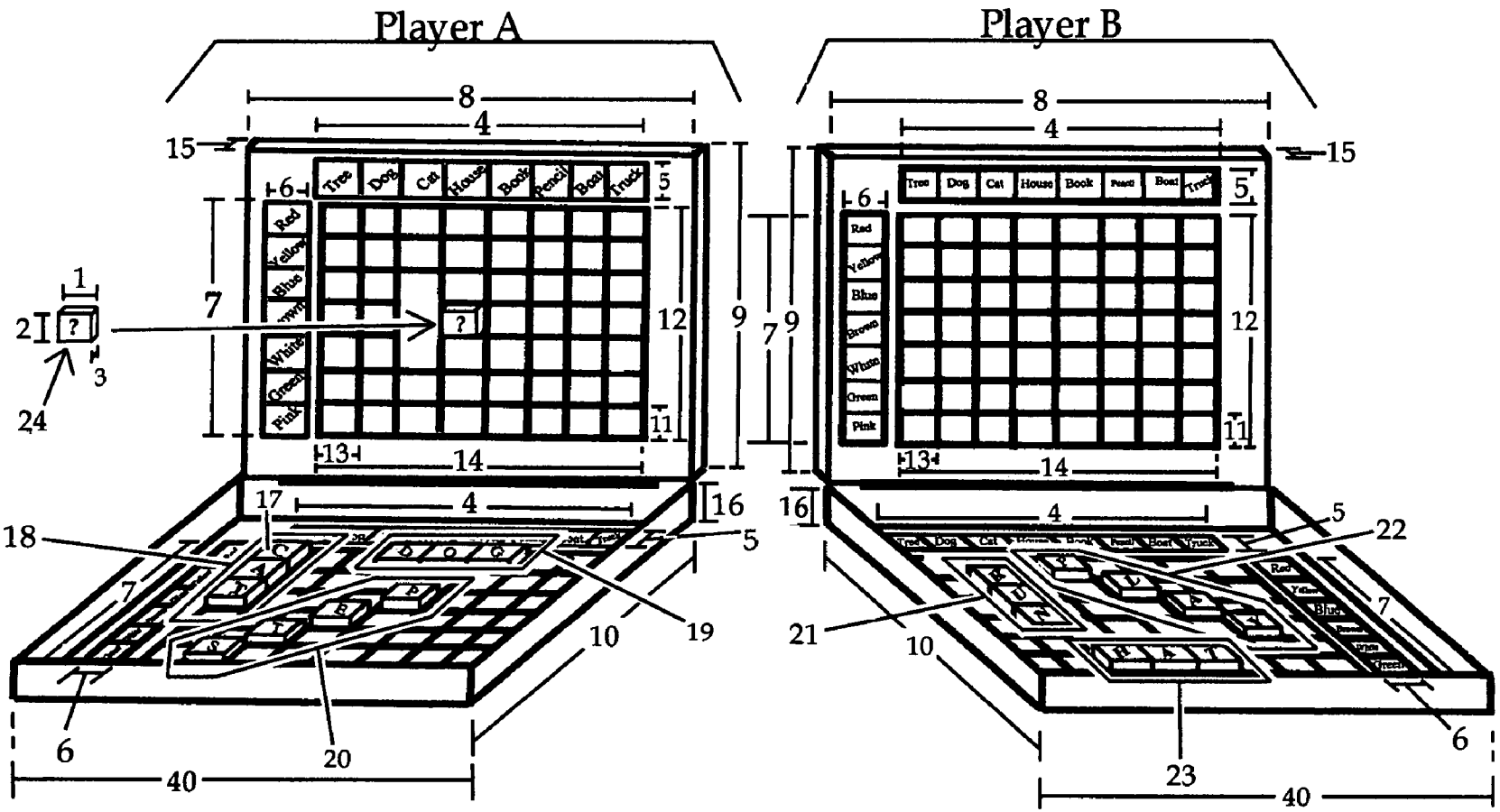
Figure 14:
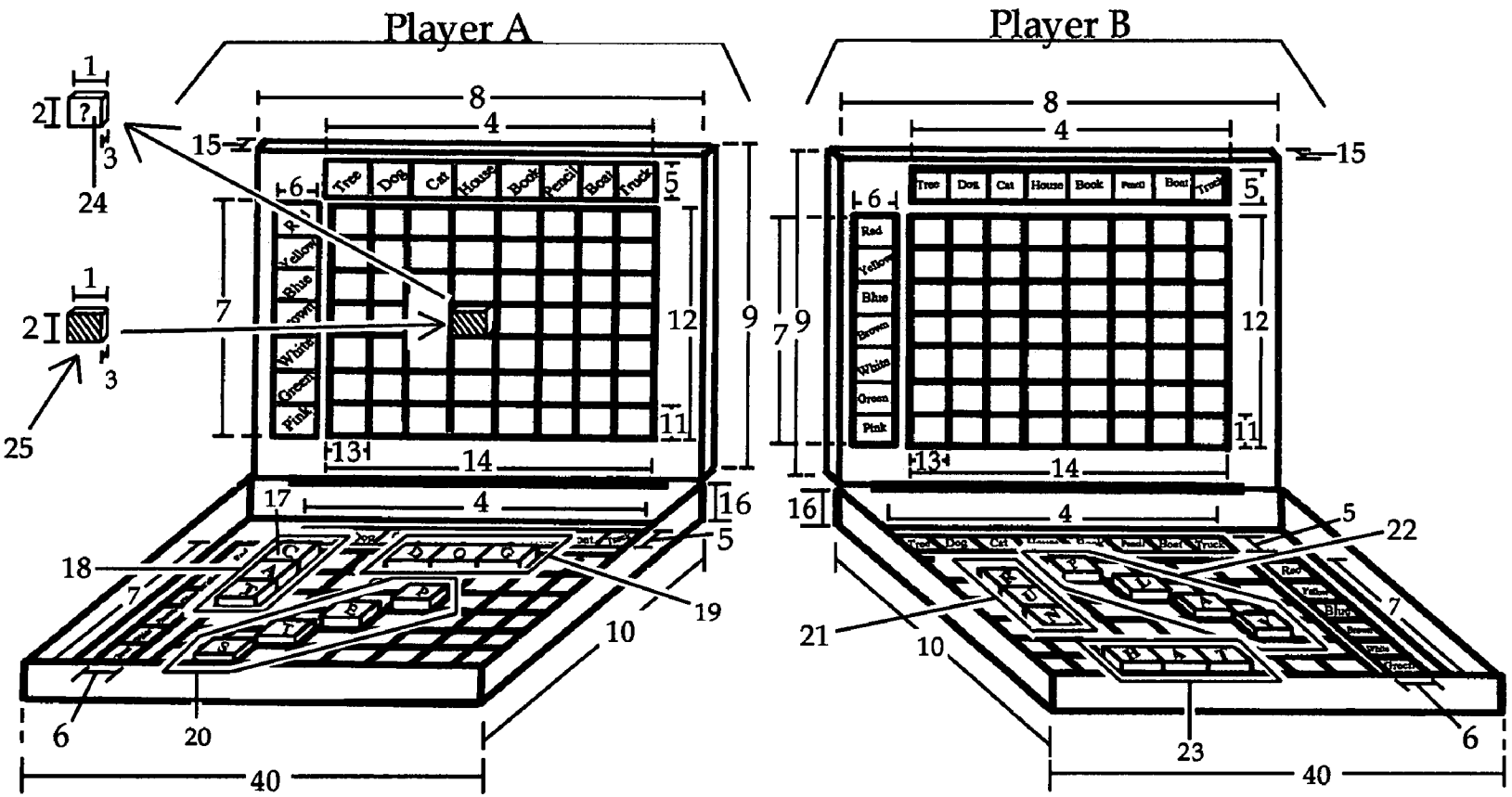

Player A goes first. In this example, Player A, who is to the left of Player B (FIG. 12) places a magnetized question mark chip (FIG. 13 (24)) onto the desired upper interior coordinate, which represents the targeted region of the opponent. In this case, Player A selects player B's Brown House coordinate (FIG. 13). The player announces this chosen coordinate to the opponent. As there is no letter on the Brown House coordinate, Player A replaces the question mark chip with a red chip (FIG. 14 (25)), indicating there was nothing on that coordinate.

It is now Player B's turn.

Figure 15:
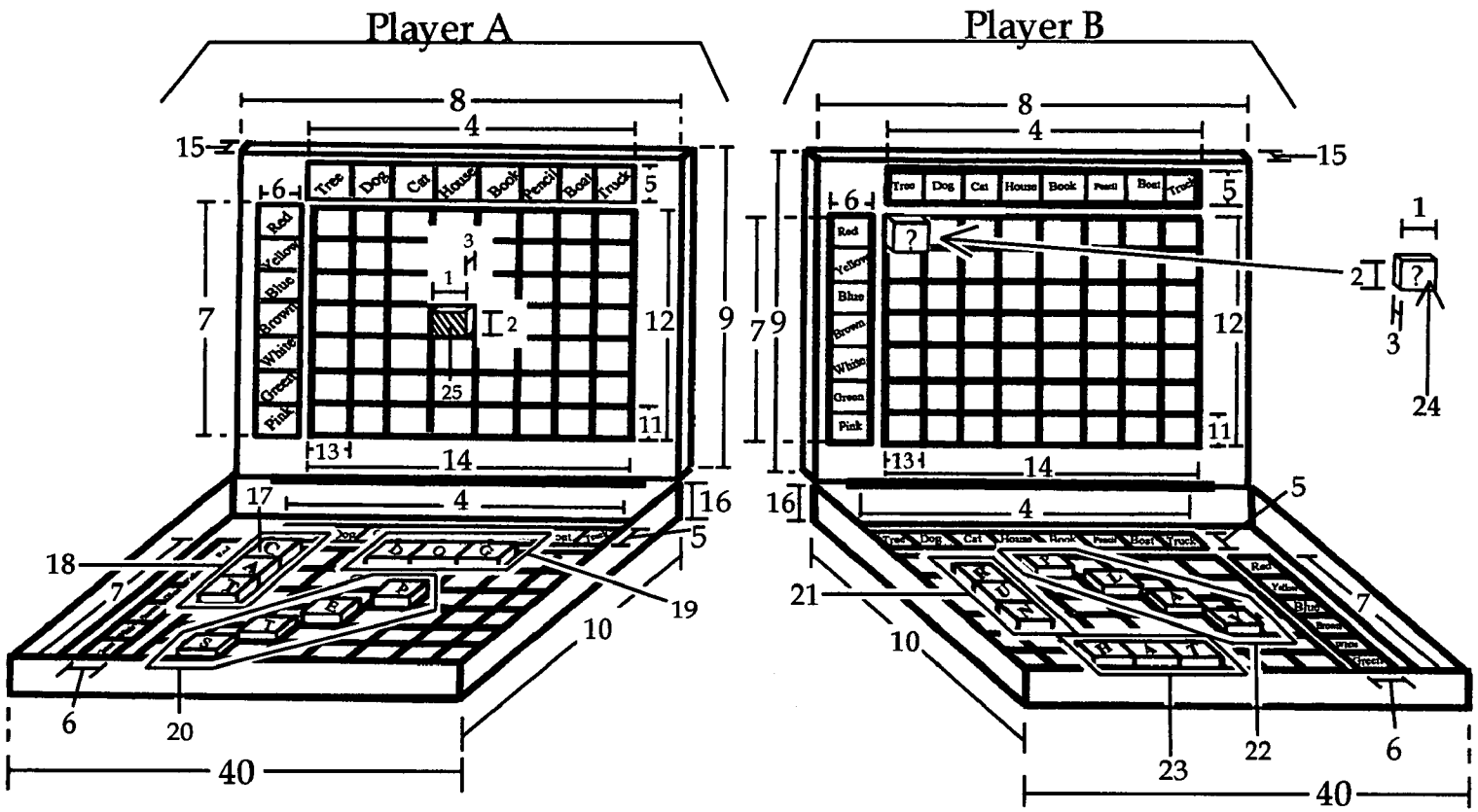

Player B places a question mark chip (24) onto the Red Tree coordinate of his or her upper interior game grid (FIG. 15), as this respectively represents the opponent's targeted bottom interior region.

Upon this selection, Player A concurs that there is in fact a letter on Red Tree. Player B now has a choice of two moves: (1) take a direct aim at a single letter in the alphabet by choosing and calling out a letter and hoping that letter is in fact the correct letter in the opponent's grid coordinate, or (2) select a range within the alphabet to narrow the search for the letter. If a range is selected, it must contain the letter on that coordinate in order to proceed to capture in that turn. The player would then choose another range within the first, or call a letter outright, hoping he/she is correct.

Player B chooses to randomly call a letter, selecting "M" as the choice. This is incorrect. Player B makes a written notation of this. The question mark chip, however, remains on Red Tree coordinate as he/she can come back to it in the next turn to pursue further, or elect to go onto another coordinate, if that is so desired.

It is now Player A's turn.

Figure 17:
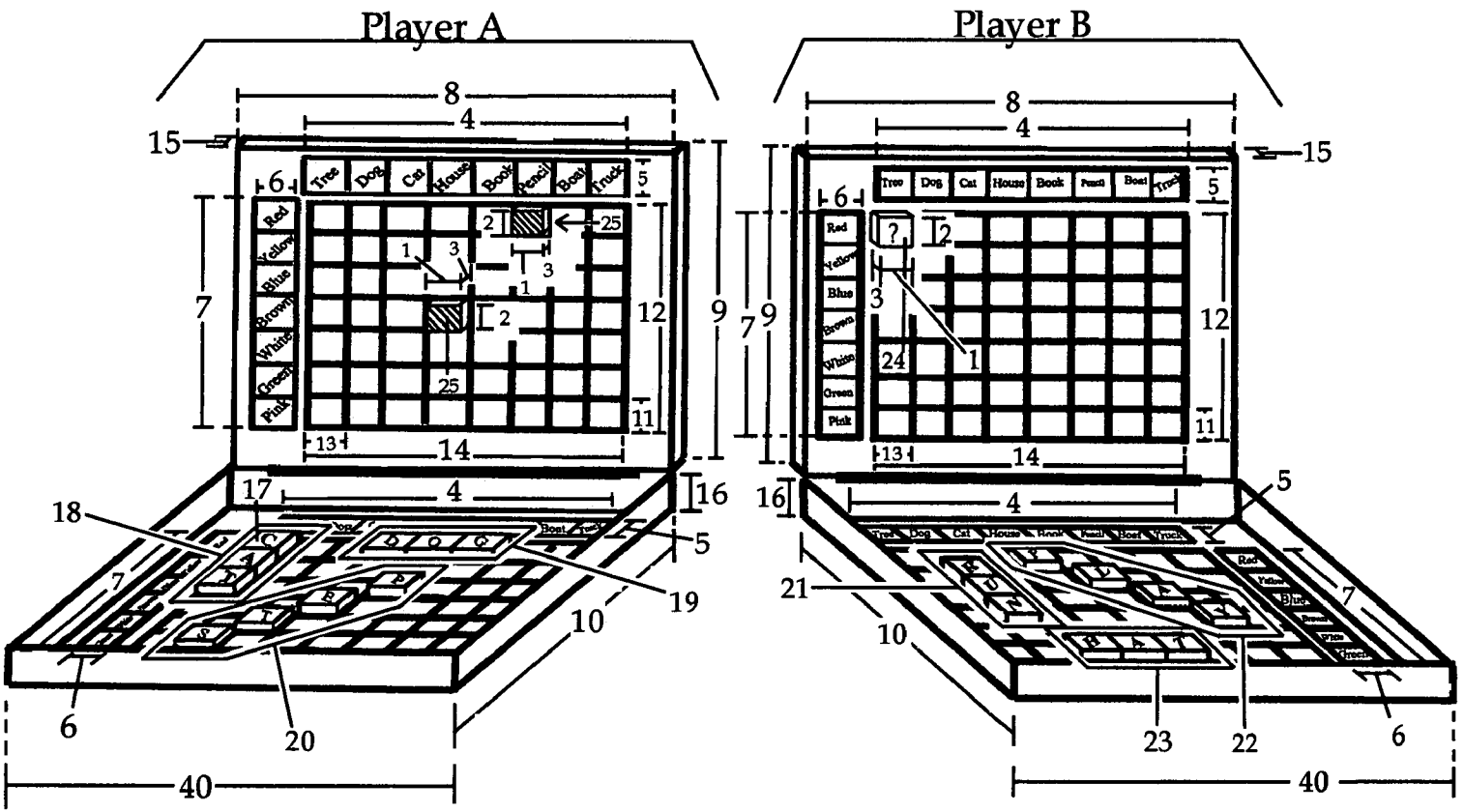

Player A places a question mark chip 24 on Red Pencil (FIG. 16), announcing his/her selection of that target. There is, of course, no letter occupying that space. Consequently, the question mark chip is replaced with a red chip 25 on the targeted Red Pencil coordinate (FIG. 17).

It is now Player B's turn.

Player B now has two opportunities: (1) select a new coordinate, or (2) elect to continue in pursuing the Red Tree coordinate whereupon he/she can either select a range within the alphabet to narrow the search, or arbitrarily target another individual letter. Player B decides to select a range this time.

Figure 18:
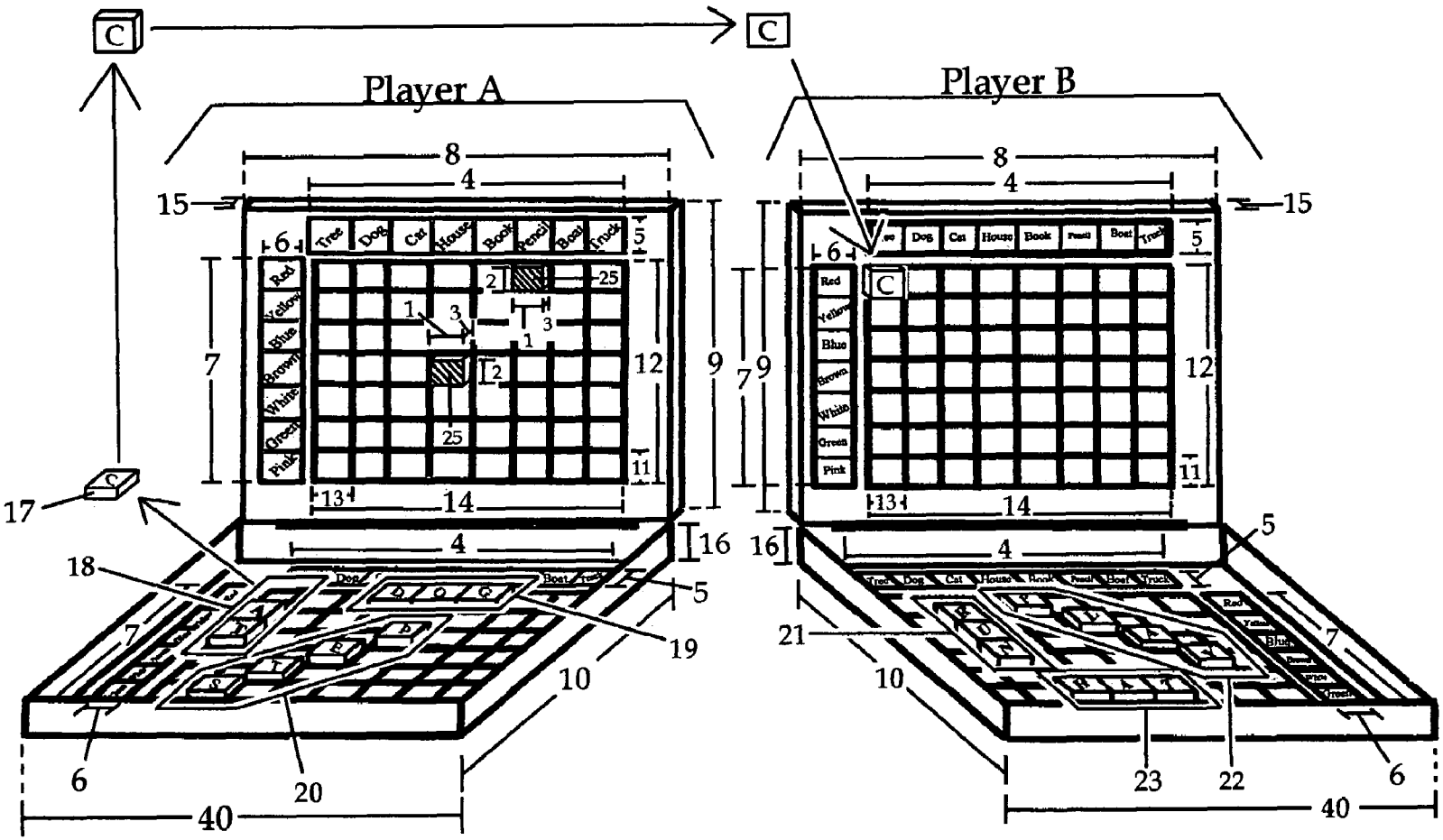

Player B calls the range of "B" through "F". This is correct as the opponent's letter on the Red Tree coordinate falls within that range. Player B makes a written notation, and can either continue to narrow the range by selecting new upper and lower limits within the range just chosen or call a single letter within the "B" through "F" range in hopes of capturing that piece. Player B in fact calls as his/her target the letter "C". This is correct and Player A removes the "C" from his/her interior bottom grid and gives it to player B, who then attaches it to the Red Tree coordinate in place of the question mark chip on his/her upper interior grid (FIG. 18).

Player A may replace the "C" chip with a black colored one on his/her bottom grid to signify its loss, but this is optional.

Figure 19:
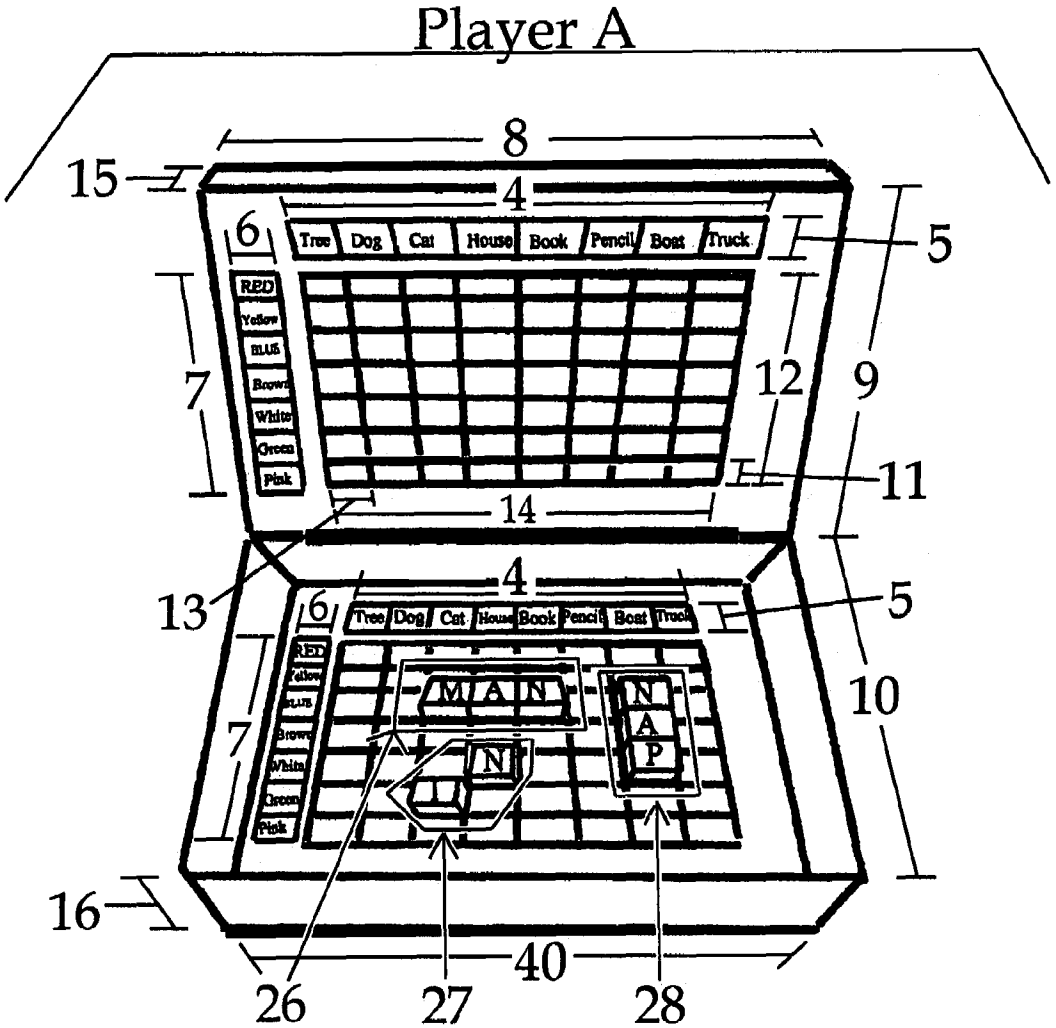
FIG. 19 shows Player A pre-positioning of letters/words onto his/her bottom interior playing field (grid) for play among three opponents.
Figure 21:
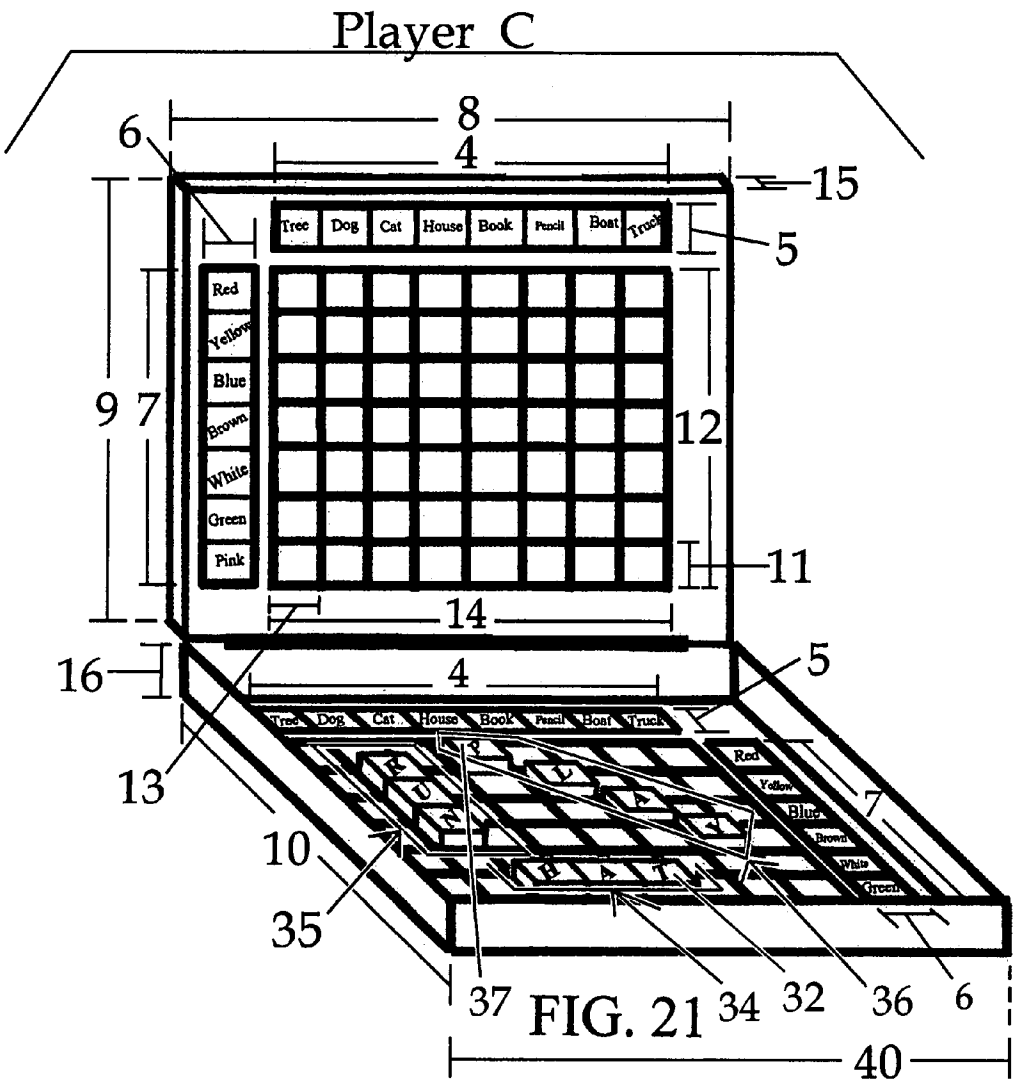
FIG. 21 shows Player C pre-positioning of letters/words onto his/her bottom interior playing field (grid) for play among three opponents.
Figure 22:
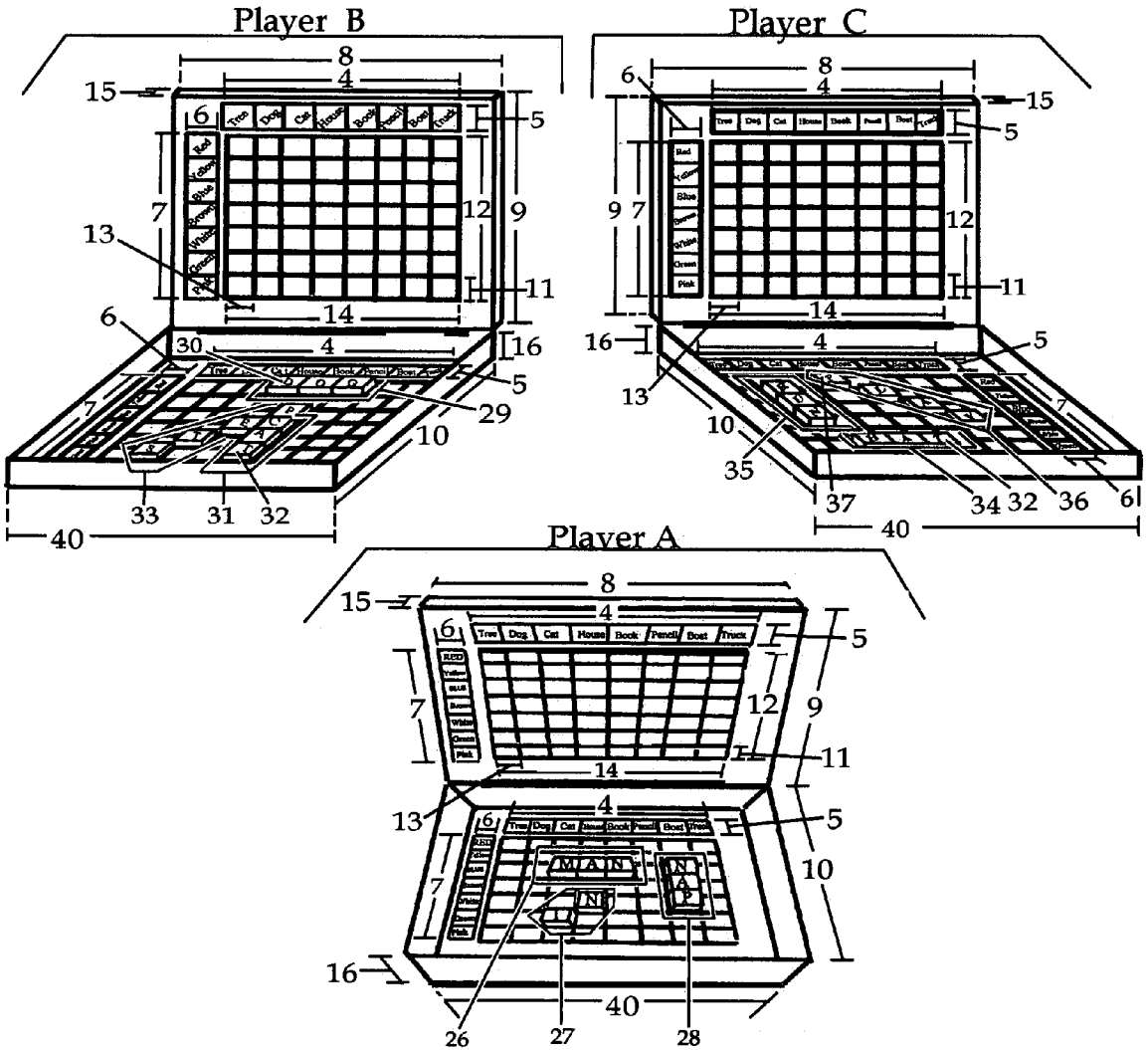
FIG. 22 shows the three players pre-positioning of letters/words before game start, with Player A in the lower center foreground, Player B to the upper left of Player A, and Player C to the upper right of Player A.
Figure 23:
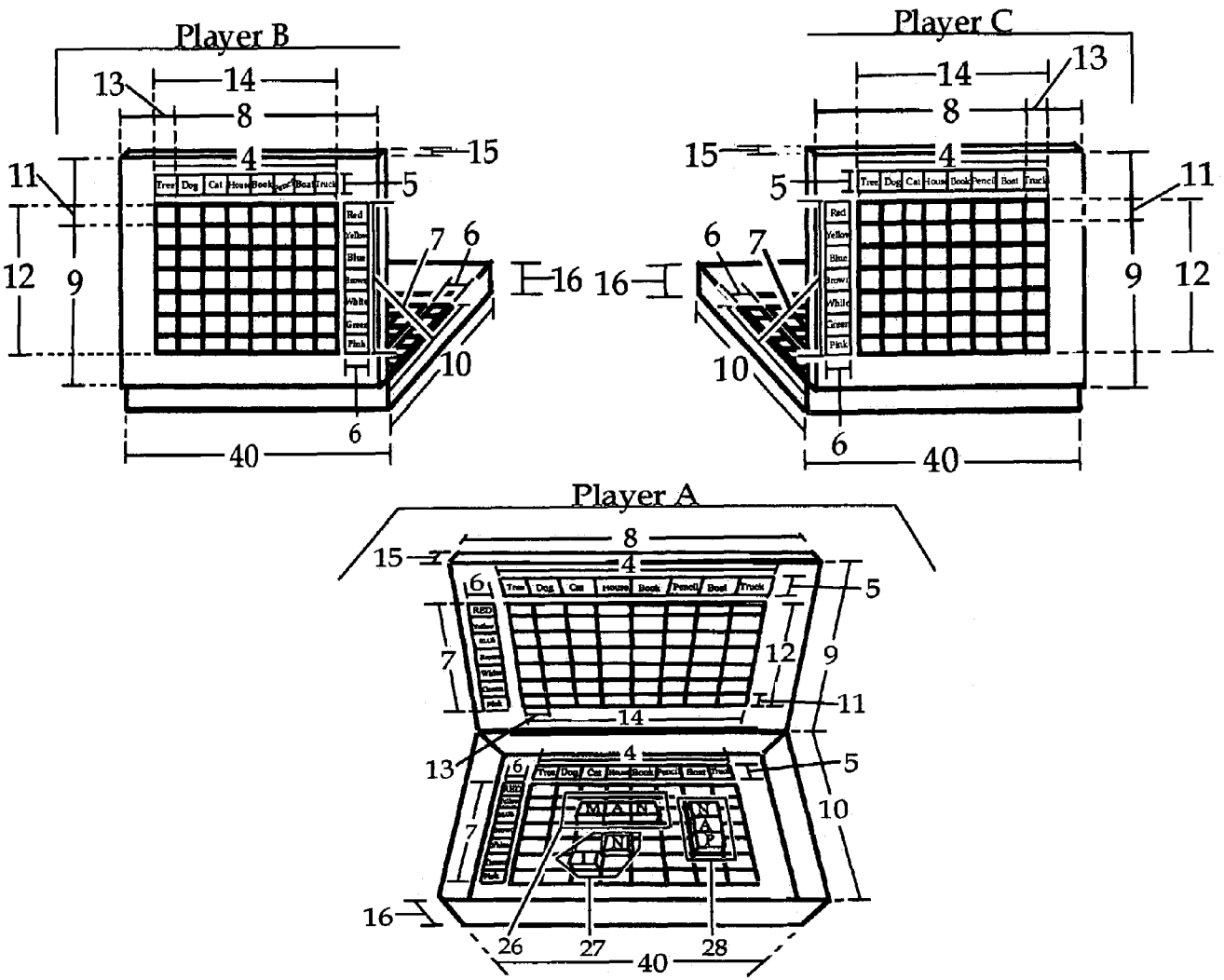
FIG. 23 shows Players A, B and C with game grid apparatuses re-angled away from one another as would be the case in live competition.

And so the game continues until one of the opponents captures all of the other competitor's letters, at which time that player with letters remaining on his/her grid wins.

Where the competition involves three or more players, the same rules apply regarding only two opponents, but with some variation in play. For our illustration, Player A is shown to have assembled the words 26 "Man", 27 "In" and 28 "Nap" in FIG. 19, Player B is shown to have assembled the words 29 "Dog", 31 "Cat" and 33 "Step" in FIG. 20, and player C is shown to have assembled the words 34 "Hat", 35 "Run" and 36 "Play" in FIG. 21. FIG. 22 demonstrates Player A in the lower center, with Player B in the upper left of Player A and Player C in the upper right of Player A. FIG. 23 demonstrates the apparatuses re-angled as would be the case in near-actual play.

Figure 20:
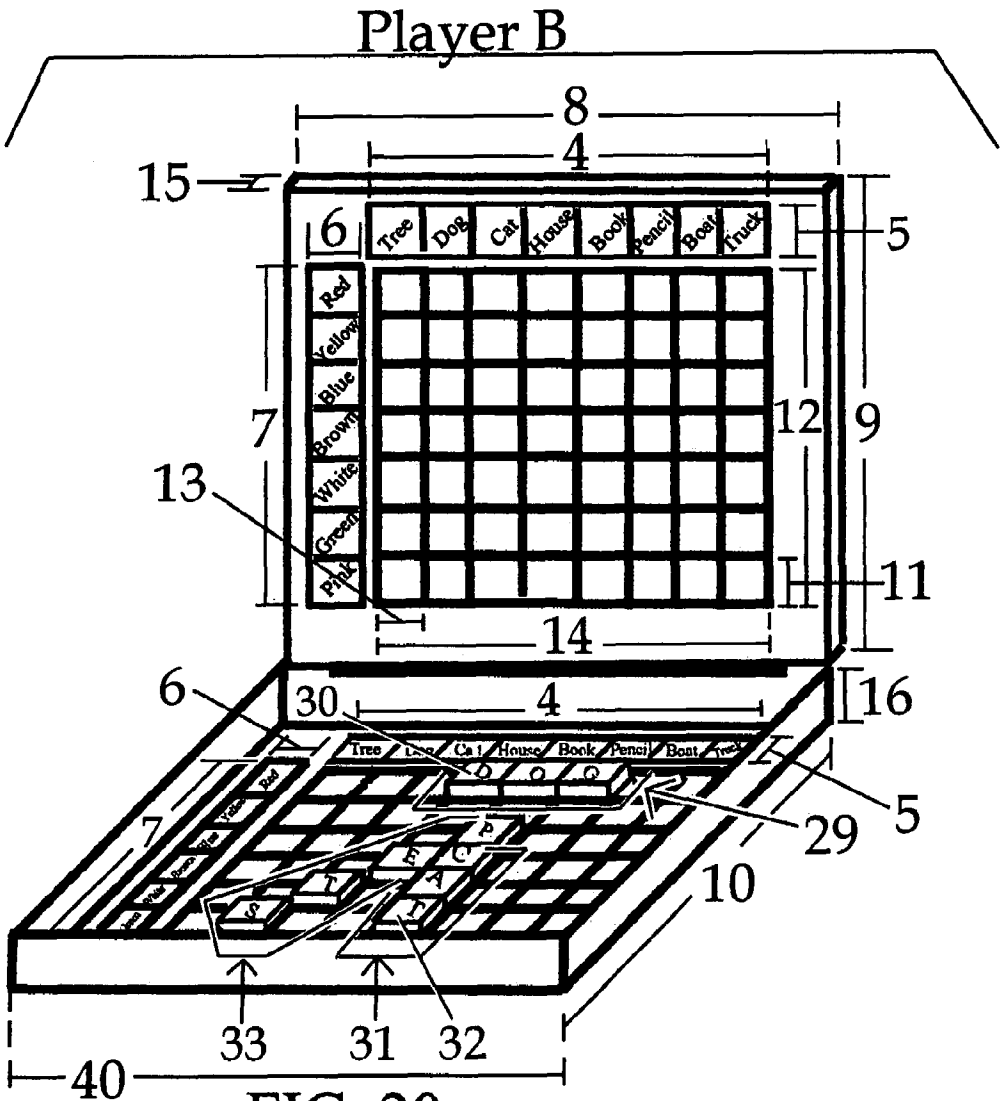
FIG. 20 shows Player B pre-positioning of letters/words onto his/her bottom interior playing field (grid) for play among three opponents.
Figure 24:
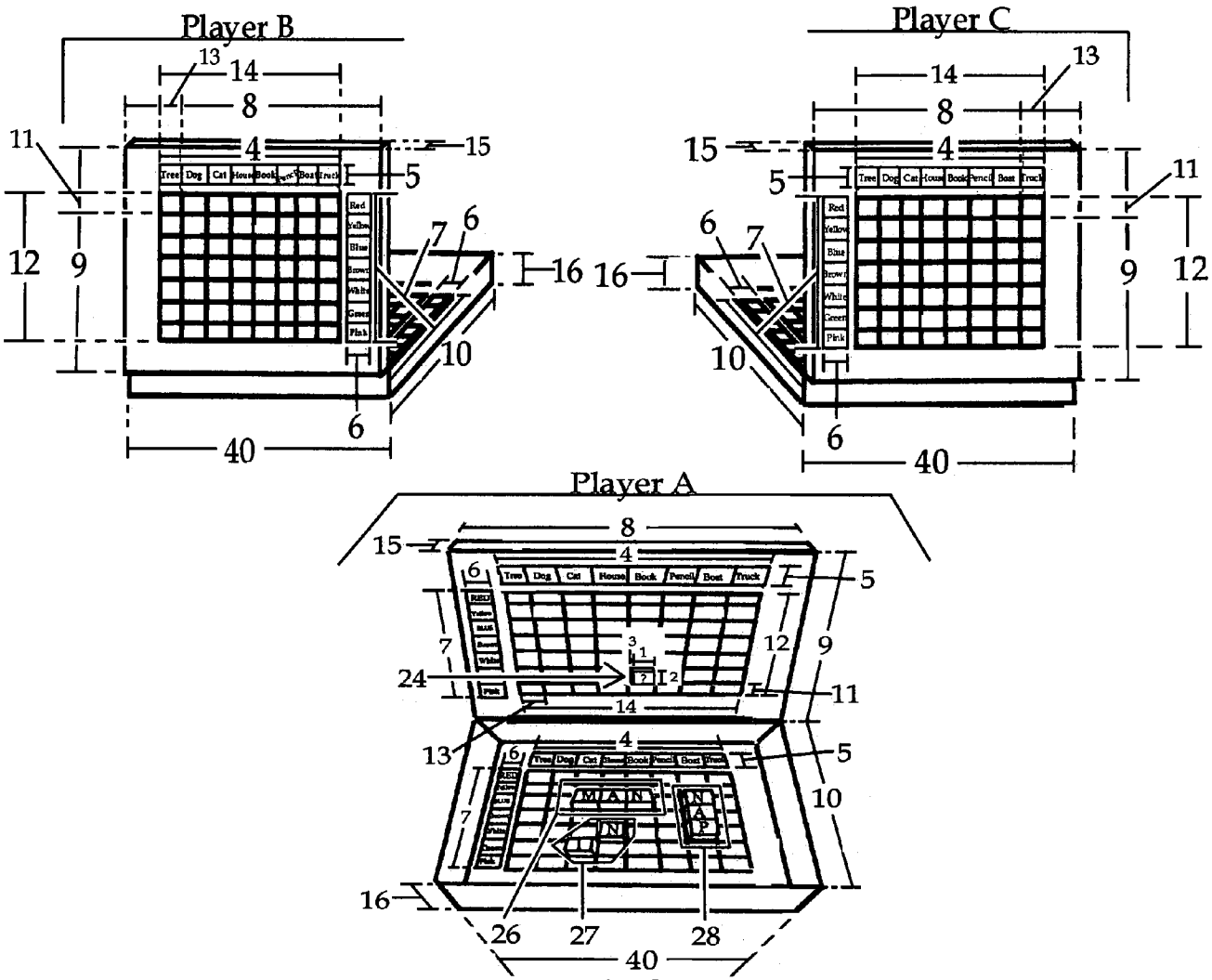
FIG. 24 through FIG. 32 demonstrate a typical round of play, with player's turn switching from Player A to Player B on FIG. 29 so that Player B is now in the lower center foreground, and Player C is to the upper left of player B and Player A is to the upper right of Player B.
Figure 24A:
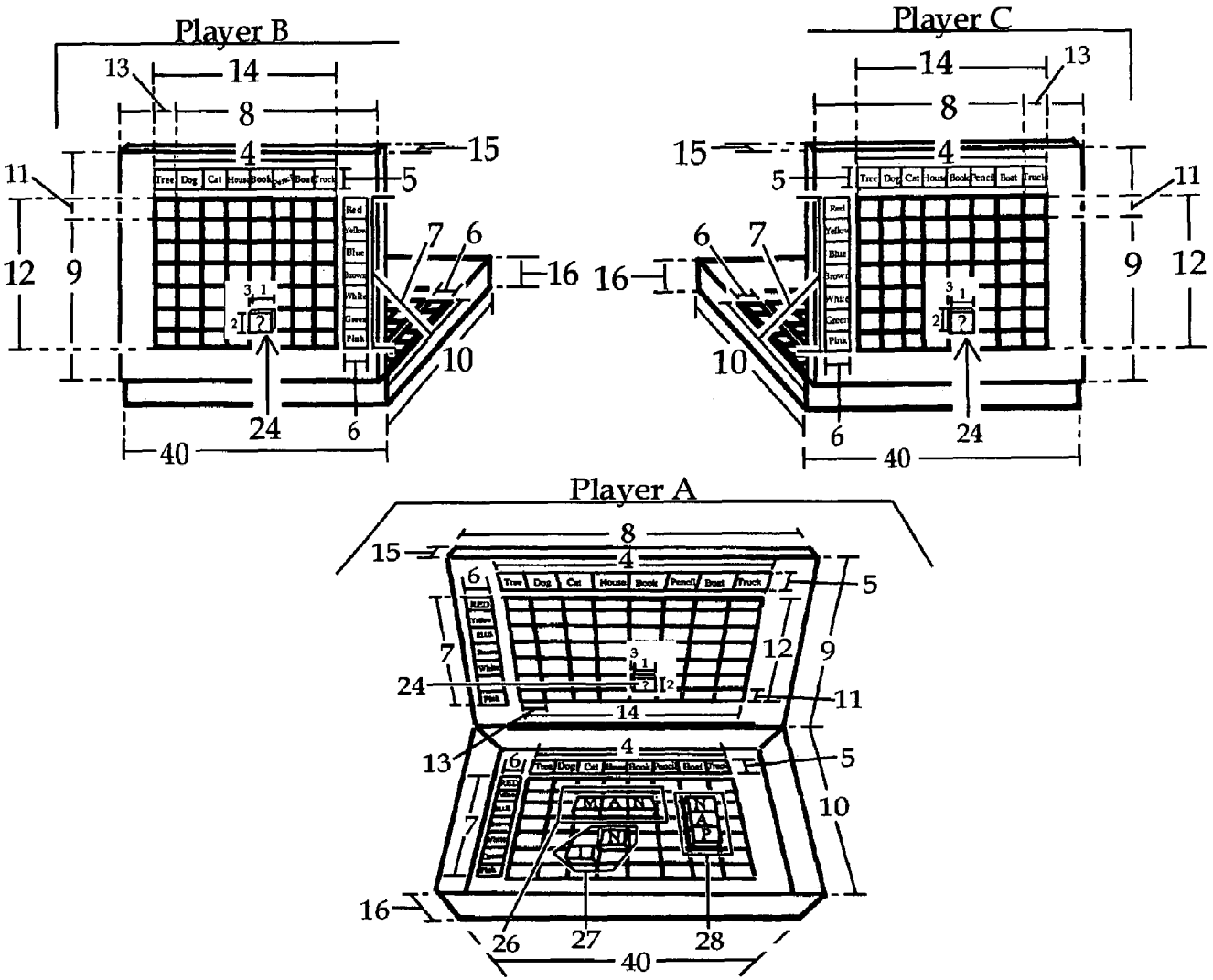

In a case where an opponent, say player A (FIG. 19), places a question mark chip 24 onto a coordinate, such as Green Book (FIG. 24), and both or all opponents have letters on that coordinate (as shown in FIG. 20 regarding player B and in FIG. 21 regarding player C), then Player A has the choice of selecting whichever opponent to pursue. At this point, Player B and Player C must place question mark chips 24 on the Green Book coordinates of their exterior grids (FIG. 24*a*), the ones located on the lids which, when in upright position, face the other opponents. If one or none of the players had letters on that coordinate, then said opponents would place red chips on the exterior grid coordinates chosen in that player's turn.

In this instance, Player A targets player B (located in upper left of FIGS. 22 through 28). Unbeknownst to the players, both players B and C have the same letter on the Green Book coordinate. All that is known at this point in the competition is that Players B and C have letters occupying that coordinate.

Player A has a choice. Following selection of Player B, he/she can either choose a range and continue narrowing that range, so long as each attempt contains the opponent's letter, or simply call out a letter. If Player A chooses an incorrect range or letter, he/she can pick up where he/she left off, depending on whether or not other players have already elected to pick up where that player left off and succeeded in capturing that lettered piece first.

Player A selects the range "k" through "v". The player is successful in continuing to narrow the range until the letter "T" is correctly hit.

Figure 25:
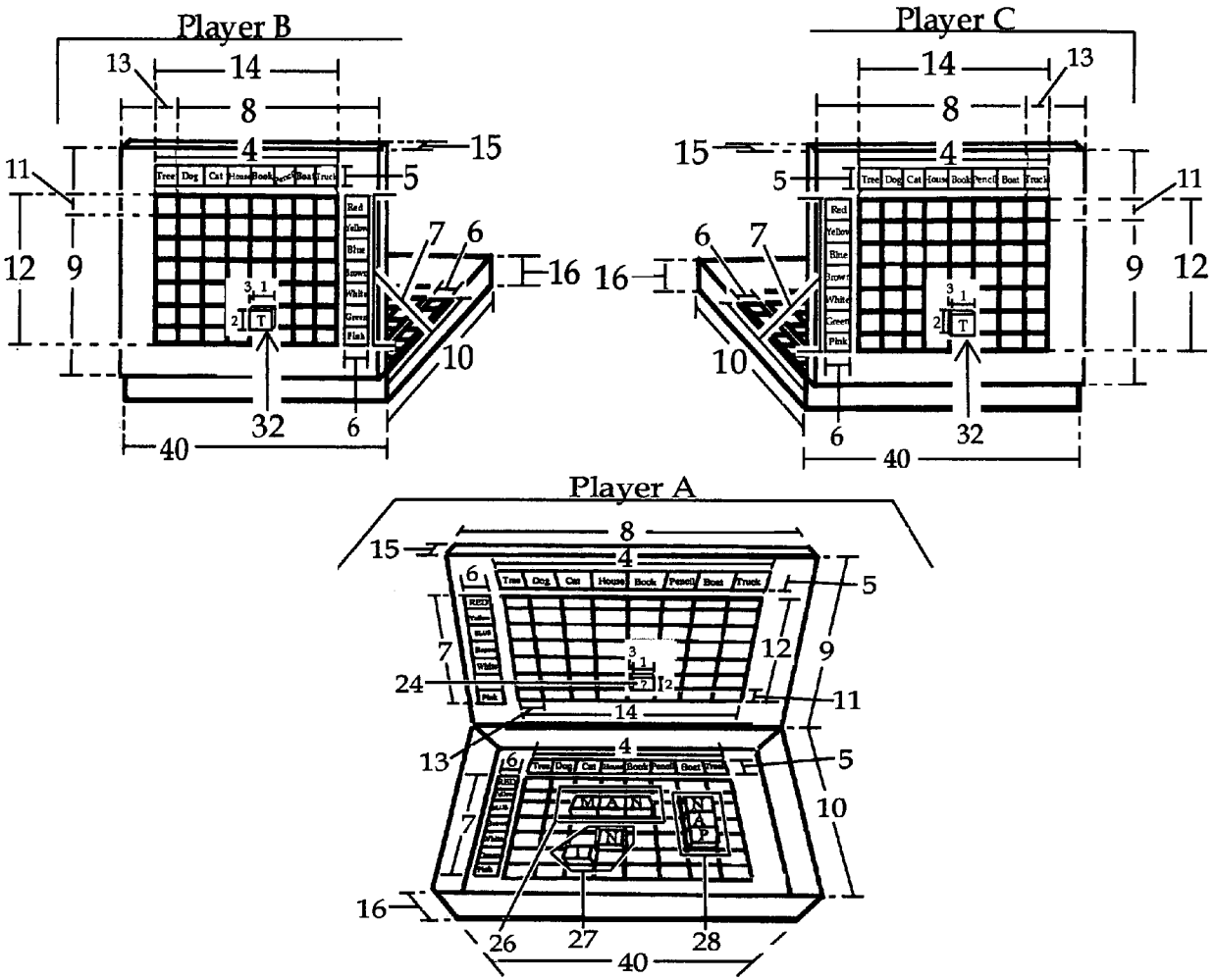

Because both opponents have occupied their Green Book coordinates with the letter "T", once the hit on player B is correctly made, all other players must relinquish their "T" chips. In this case, Players B and C remove the "T" chips 32 from their interior bottom grids and stick them onto their outer grids of the same coordinate (FIG. 25).

Figure 26:
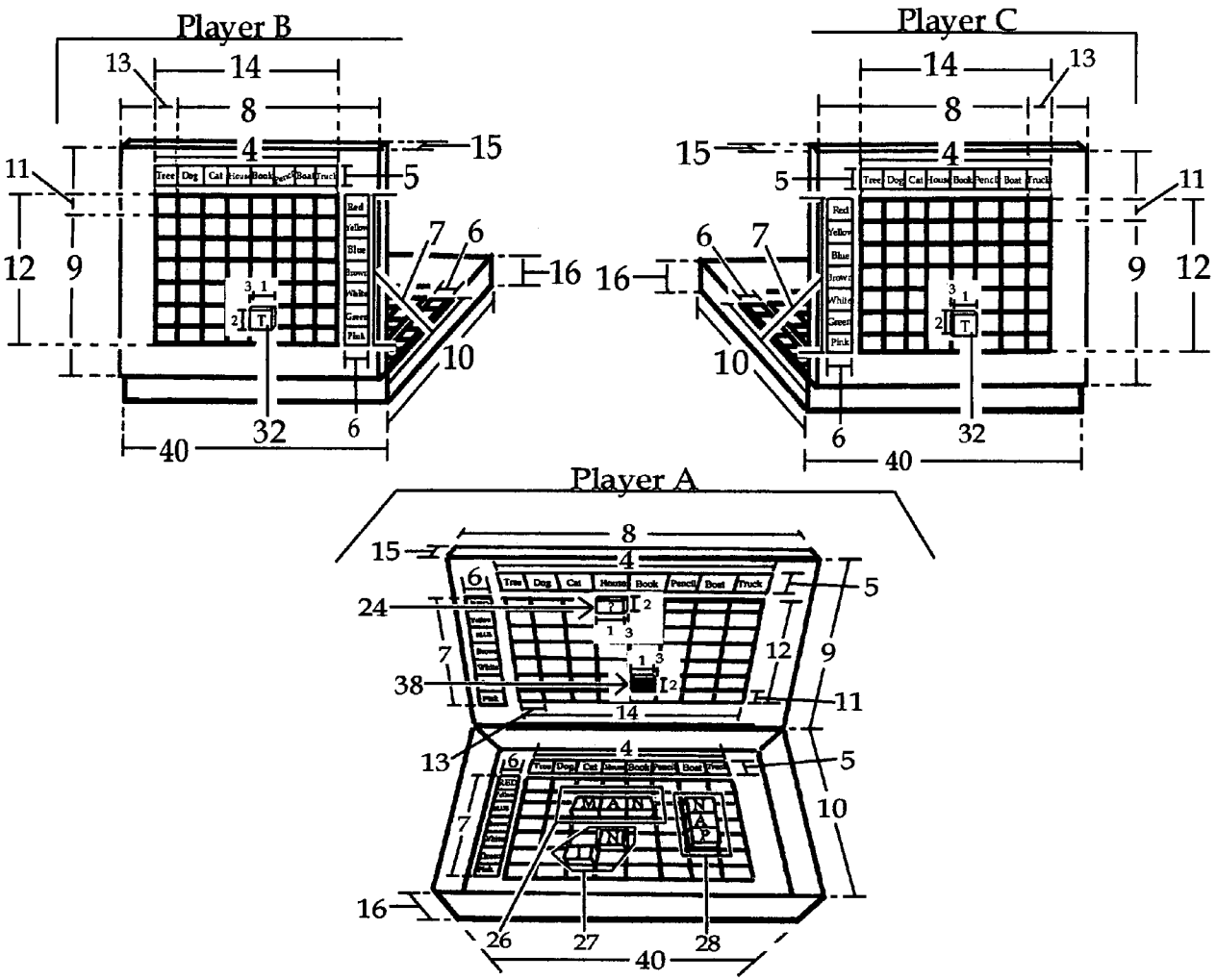

Player A places a black chip (FIG. 26 (38)) onto the Green Book coordinate of his/her upper interior grid. Players B and C have the choice of placing black chips in place of the "T" chips on their lower interior grids, but this is optional for those players.

Figure 27:
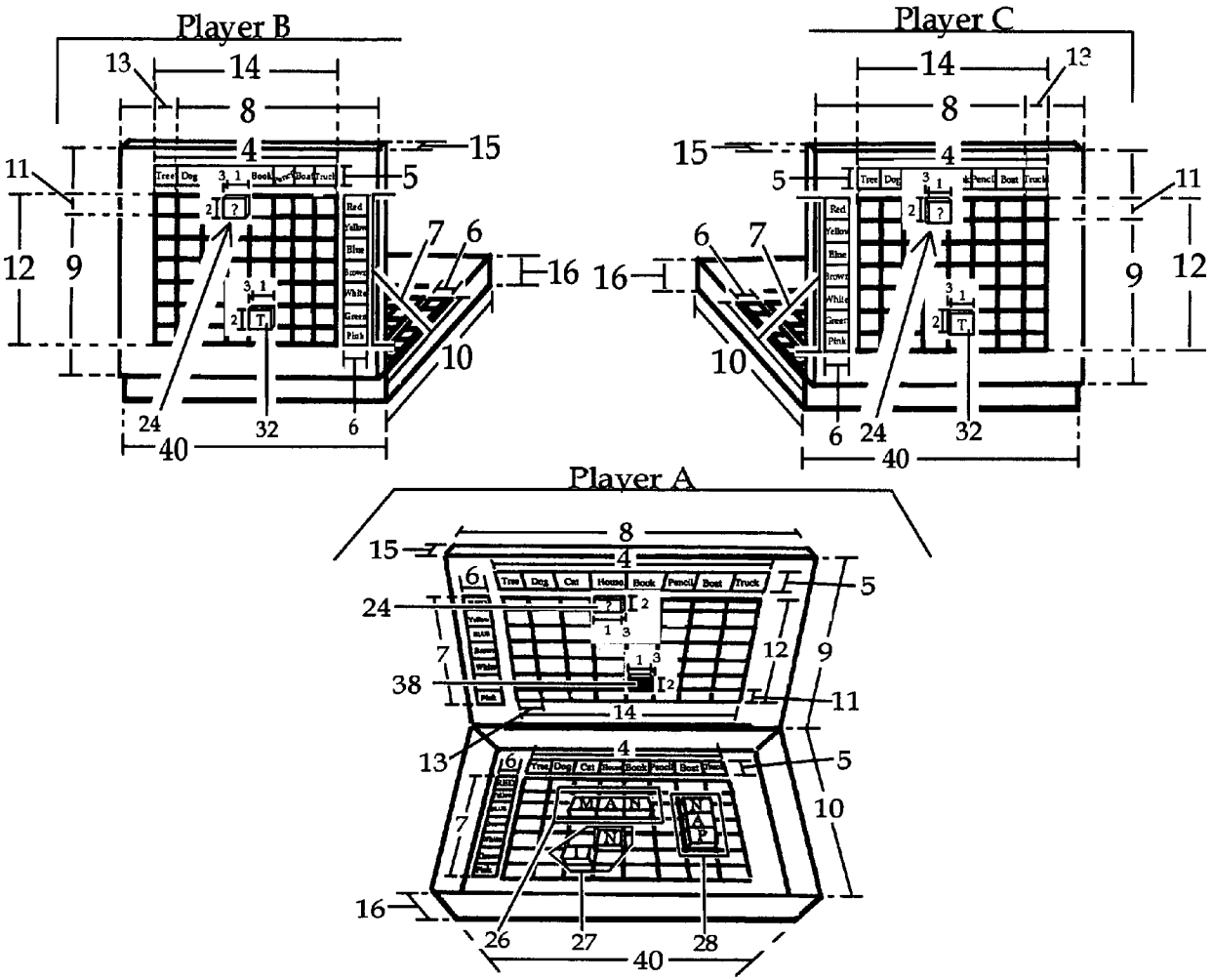

Player A continues in his/her turn. Player A now places a question mark chip 24 onto the Red House coordinate of his/her interior upper grid and announces this selection to the other players (FIG. 26). Since both players B and C have letters on this coordinate, they place question marked chips 24 on the same coordinates of their outer grids (FIG. 27).

Player A elects to pursue Player B.

Figure 28:
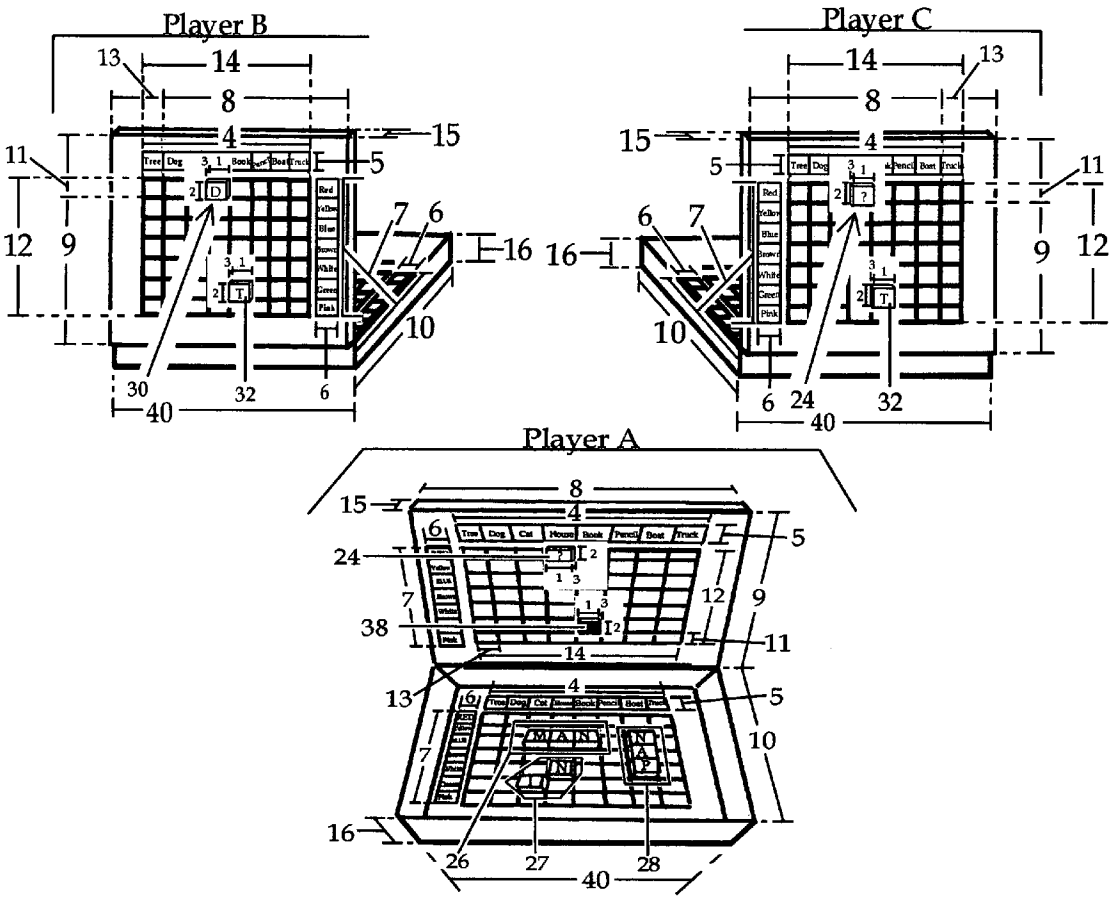

Player A continues to select ranges to narrow the letter hit, then calls a letter outright. Player A successfully calls Player B's "D" chip 30 on the Red House coordinate (FIG. 28). Player B removes the question marked chip from his/her outer grid and puts in its place the "D" chip from his/her interior bottom grid. Player A now targets Player C.

Player A is unsuccessful in selecting the correct range or letter therein for Player C's coordinate.

It is now Player B's turn.

Figure 29:
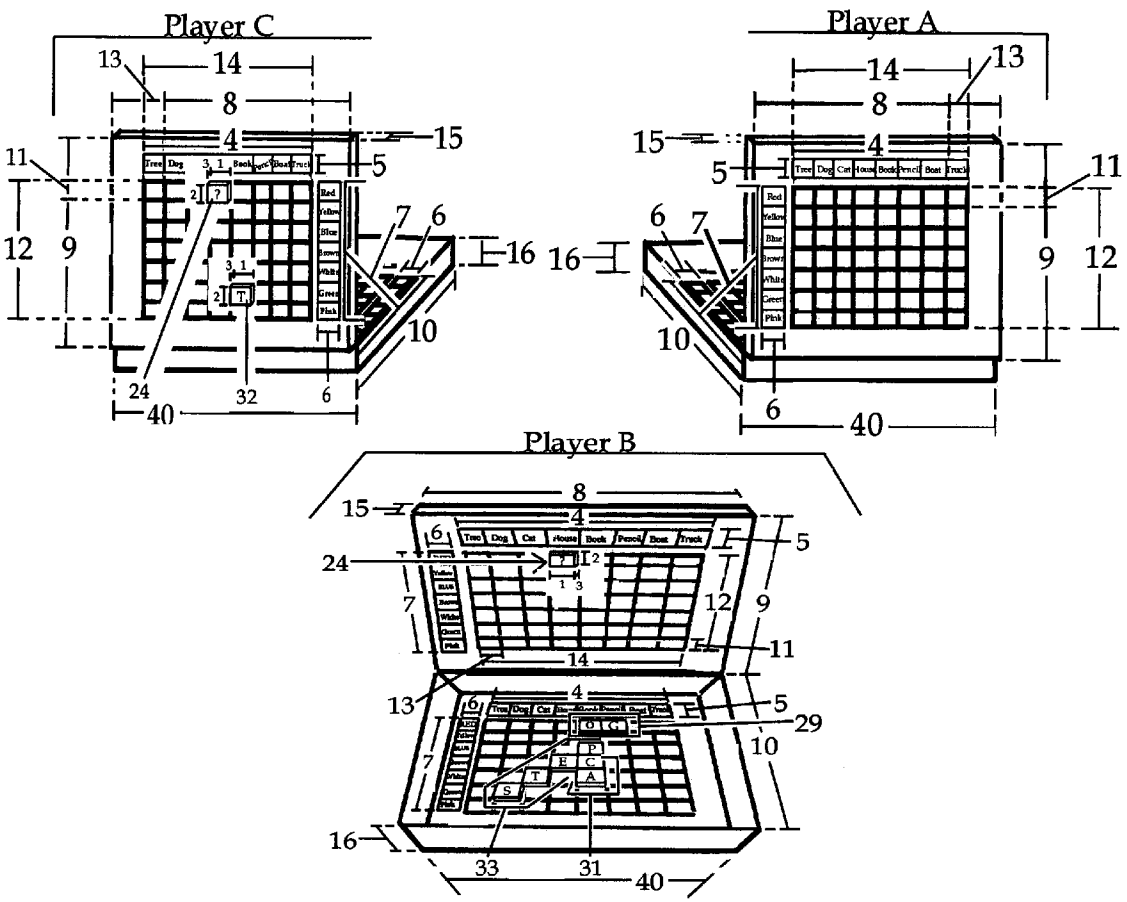

Player B, who is now in the lower center foreground of FIG. 29 with Player C to the upper left and Player A now to the upper right, takes advantage of this opportunity to pursue Player C's Red House coordinate by placing a question mark chip (24) onto that coordinate of his/her interior upper grid (FIG. 29).

Figure 30:
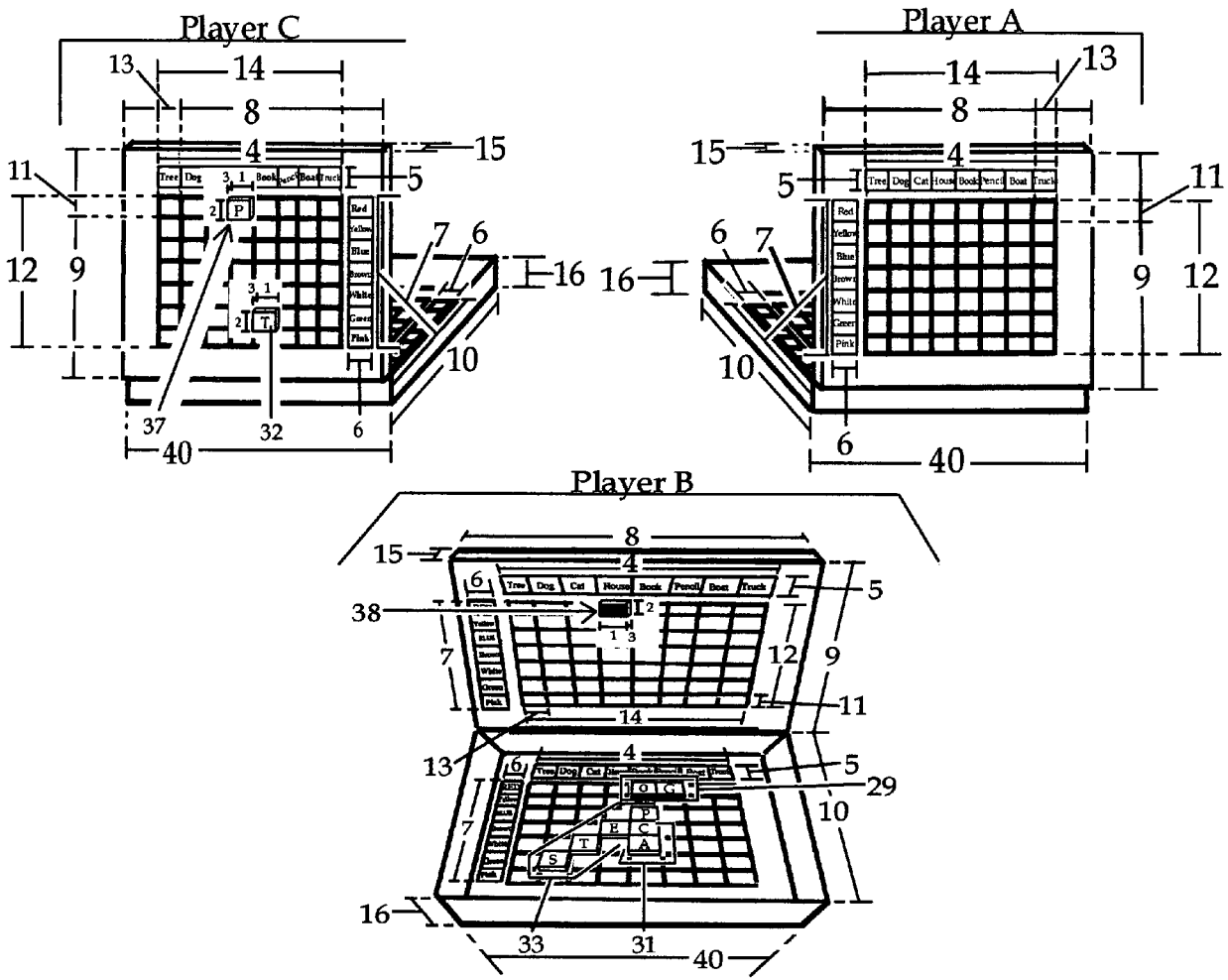

Ultimately, either through selection of ranges and narrowing down to the correct letter, or by simply calling out the letter, Player B is successful in eliminating that opponent's letter off his/her grid. The "?" 24 of Player C's external grid is now replaced with that player's "P" chip 37 and player B places a black chip 38 on the Red House coordinate (FIG. 30). It is optional for Player C to place a black chip onto his/her lower internal grid.

Player B continues in completion.

Figure 31:
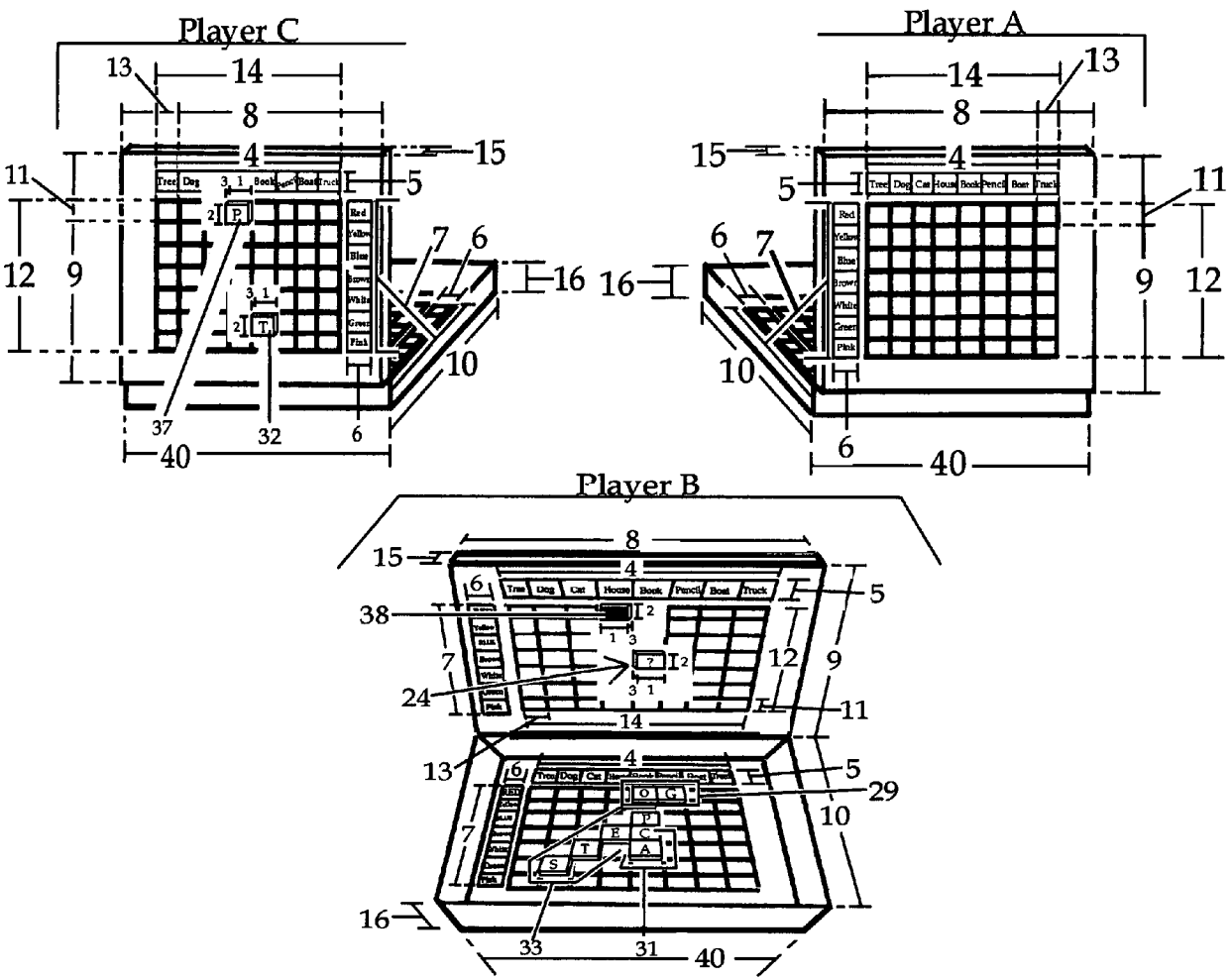
Figure 32:
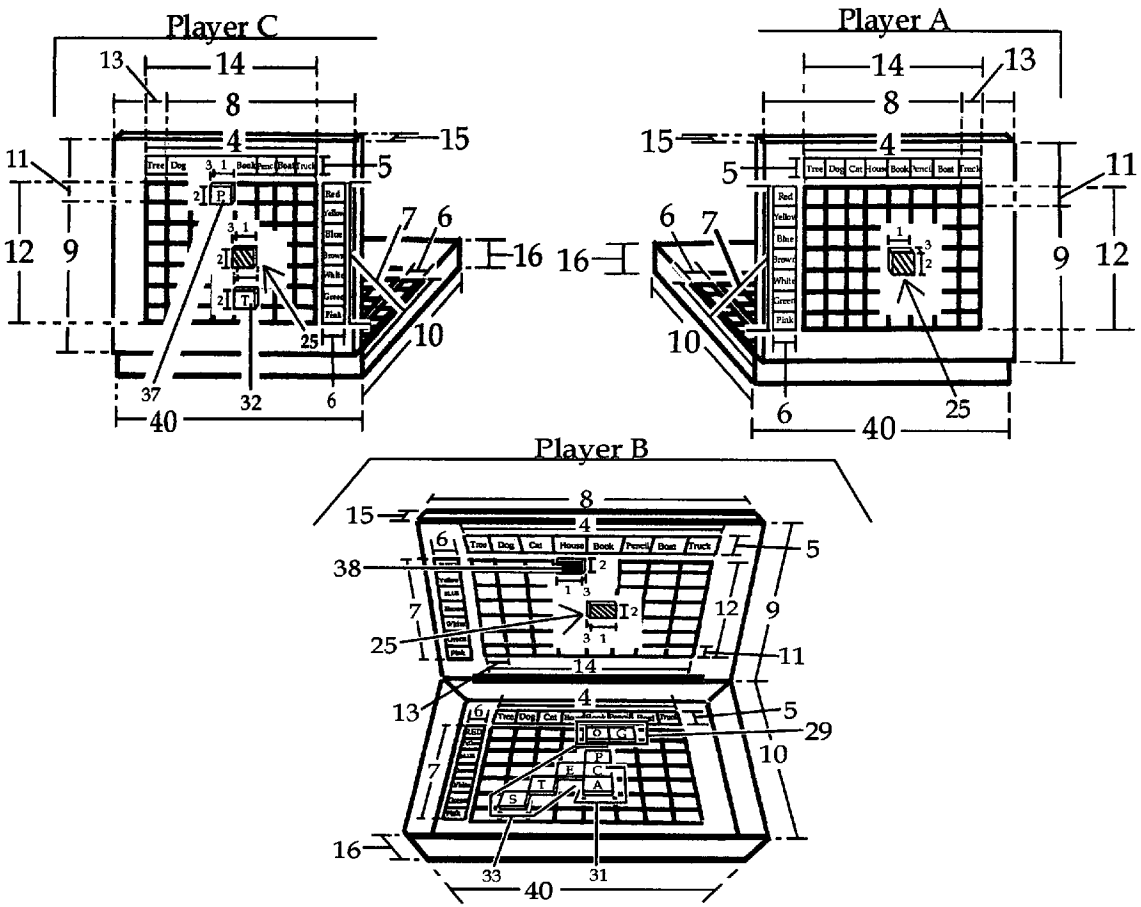

Player B places a question mark chip 24 onto the Brown Book space (FIG. 31). This coordinate is not occupied by any letter in either player C's or Player A's interior lower game grid action area. Therefore, red chips 25 are placed on both Player C's and Player A's outer grids, and on Player B's upper, interior grid (FIG. 32), but not on Player B's outer grid as it was his/her turn, and he/she in fact has a letter "C" on that coordinate, yielding a future, potential success for either player to eliminate Player B's "C" chip on that coordinate once it has been determined by the other player(s) that in fact Player B has a letter on that coordinate.

What is being claimed is:

1. In a method of playing a word discovery game apparatus comprising:

a rectangular closable-type box, the rectangular closable-type box including a rectangular lid and a rectangular open-sided bottom container of congruent length and height, wherein a rectangular lid and a rectangular open-sided bottom container are hinged together on one side so as to be closed, and when opened to a ninety-degree angle then reveal three separate playing fields each of congruent dimensions, with each playing field being a rectangular grid defined by a predetermined number of rows and columns which are sectioned into individual unit spaces, with each playing field having an equal number of rows and columns, and where each unit space of each grid is of congruent dimensions;

a first playing field, located inside a rectangular closable-type box on a surface of a rectangular open-sided bottom container, that is used as an action area for placing a first set of game pieces that are received onto and removed from individual coordinates of that playing field for the purpose of spelling words in any direction;

a second playing field, located inside a rectangular closable-type box on a surface underneath a lid, that is used, in competition of two or more players, for the purpose of selecting individual coordinates that may be occupied by letters in the corresponding spaces of opponent's first playing fields, and where the status of those chosen coordinates, either occupied or unoccupied by letters, is recorded through the utilization of a first set, a second set, a third set and a fourth set of game pieces which are placed onto those chosen coordinates of a second playing field during competition;

a third playing field, located on top of a rectangular lid surface, that is used, in competition of three or more players, to record the status of individual selected coordinates by placing a first set, a second set and a fourth set of game pieces onto coordinates of a third playing field to display for all opponents which letters on opponents' first playing fields have been discovered, which spaces on opponents' first playing fields are occupied by unknown letters, and which spaces on opponents' first playing fields have not been prepositioned with letters;

a perimeter of space equal to one row of grid units surrounding all three playing fields;

a coordinate label, adhered with magnetic backing so as to allow for its placement above, below and to the sides of each playing field, sectioned into unit spaces corresponding with the same number of unit spaces found in each row and column of all playing fields, with each sectioned space marked with an identifying symbol for the purpose of coordinate identification;

four sets of game pieces wherein a first set of game pieces each has one letter imprinted on it and which are adhered with magnetic backing on the opposite side so as to allow each to be received onto and removed from individual unit space coordinates of the playing fields for the spelling of words;

a second set of game pieces that each has a question mark imprinted on it and which are adhered with magnetic backing on the opposite side so as to allow each to be received onto and removed from individual unit space coordinates of a second playing field, in a two-player competition where a separate rectangular closable-type box is being utilized per player, or of a second and of a third playing fields, in a three or more player competition where a separate rectangular closable-type box is being utilized per player, to indicate a selected coordinate that is currently occupied by a letter in a corresponding coordinate on an opponent's first playing field, the identity of which is not currently known;

a third set of game pieces that each has a black surface imprinted on it and which are adhered with magnetic backing on the opposite side so as to allow each to be received onto and removed from individual unit space coordinates of the playing fields, and where a third set of game pieces replaces a first set of game pieces on coordinates of a first playing field in a two-player competition when letters are discovered by an opponent so that a first set of game pieces on those spaces is in turn surrendered to an opponent to be placed on opponent's second playing field of the corresponding space, and which in turn replaces a second set game piece from that space on that opponent's second playing field, or where, in a three or more player competition, a third set of game pieces is placed on spaces of players' second playing fields which correspond to letters displayed on coordinates of opponents' third playing fields which have been successfully discovered from those opponents' first playing fields, and a fourth set of game pieces that each has a red surface imprinted on it and which are adhered by magnetic backing on the opposite side so as to allow each to be received onto and removed from individual unit space coordinates of a second playing field, in the case of a two-player competition, or a second and a third playing fields, in the case of three or more player competition, to indicate a coordinate selected by a player where no letter had been prepositioned by any opponents on those corresponding coordinates in their first playing fields.

2. The method of claim 1 further including a coordinate label wherein each sectioned unit of a label is marked with a letter.

3. The method of claim 1 further including a coordinate label wherein each sectioned unit of a label is marked with a number.

4. The method of claim 1 further including a coordinate label wherein each sectioned unit of a label is marked with an object.

5. The method of claim 1 further including a coordinate label wherein each sectioned unit of a label is marked with a color.

6. The method of claim 1 further including a coordinate label and wherein each sectioned unit of a label is marked with a person or character.

* * * * *